US006481754B2

(12) United States Patent
Fabel

(10) Patent No.: US 6,481,754 B2
(45) Date of Patent: Nov. 19, 2002

(54) MACHINE SEALABLE MAILING FORM FOR NON-IMPACT PRINTING

(75) Inventor: Warren M. Fabel, Delray Beach, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 09/864,753

(22) Filed: May 24, 2001

(65) Prior Publication Data

US 2002/0030362 A1 Mar. 14, 2002

Related U.S. Application Data

(63) Continuation-in-part of application No. 09/557,492, filed on Apr. 24, 2000, which is a continuation-in-part of application No. 09/243,003, filed on Feb. 2, 1999, now Pat. No. 6,173,888, which is a continuation-in-part of application No. 08/480,161, filed on Jun. 7, 1995, now Pat. No. 5,865,717, and a continuation-in-part of application No. 09/488,067, filed on Jan. 19, 2000, which is a continuation-in-part of application No. 09/179,224, filed on Oct. 27, 1998, now Pat. No. 6,095,919.

(51) Int. Cl.[7] ..... B42D 15/00

(52) U.S. Cl. ..... 283/116; 283/58; 229/314

(58) Field of Search ..... 283/116, 61, 62, 283/117, 57, 58; 229/304, 305, 92.8, 306, 313, 314; 462/64, 65

(56) References Cited

U.S. PATENT DOCUMENTS 5,464,255 A * 11/1995 Schildmeyer ..... 283/116
5,595,404 A * 1/1997 Skees ..... 283/62 X
5,836,622 A * 11/1998 Fabel ..... 283/62

* cited by examiner

*Primary Examiner*—Willmon Fridie, Jr.
(74) *Attorney, Agent, or Firm*—Ted W. Whitlock

(57) ABSTRACT

A pressure-seal or pressure-activated sealing means for a mailing form constructed of a single ply of substantially opaque or printable substrate material which is configured such that it can be folded to form a financial document, for example, an accounts payable or payroll check and check voucher, and wherein the ply is further folded to form an outgoing mailer envelope in which the financial document is enclosed for mailing to a recipient. The mailing form can also include a substantially transparent single ply of substrate material for providing a window area for viewing or scanning therethrough.

18 Claims, 19 Drawing Sheets

MACHINE SEALABLE MAILING FORM FOR NON-IMPACT PRINTING

CROSS-REFERENCE TO RELATED APPLICATIONS

This is a continuation-in-part of the following U.S. patent applications:

Ser. No. 09/557,492, filed Apr. 24, 2000, which is a continuation-in-part of U.S. patent application, Ser. No. 09/243,003, filed Feb. 2, 1999, and issued Jan. 16, 2001 as U.S. Pat. No. 6,173,888, which is a continuation-in part of U.S. patent application Ser. No. 08/480,161, filed Jun. 7, 1995, issued Feb. 2, 1999 as U.S. Pat. No. 5,865,717; and Ser. No. 09/488,067, filed Jan. 19, 2000, which is a continuation-in-part of U.S. patent application, Ser. No. 09/179,224 filed Oct. 27, 1998, and issued Aug. 1, 2000 as U.S. Pat. No. 6,095,919.

FIELD OF THE INVENTION

This invention related to mailing forms, and more particularly, to mailing forms which, after information is printed thereon by a simplex, non-impact printer, can be folded and subsequently machine-sealed to form into an outgoing mailer containing a printed document.

BACKGROUND OF THE INVENTION

Non-impact printers, such as laser or ink jet printers, are being increasingly used to provide a fast, economical, and convenient method of printing data developed within computer systems and stored in databases. An important example of this kind of data is accounting data of both large and small organizations. In most organizations, preparing and distributing accounts payable, e.g., payroll checks or other financial documents, e.g., tax or stock information, invoices, statements, or the like, represents a significant effort, as such account data is printed and distributed in envelopes.

Whereas many invoices, monthly statements, renewal notices, questionnaires and the like arrive in a single envelope together with a number of other printed documents such as a return envelope and a response document, certain payments or periodic informational mailings do not require a response from the receiver of the information.

Multi-part forms, including envelopes in which documents are sent, together with the documents themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that impact printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially among small business organizations, the percentage of organizations having the impact printers necessary to use such multi-part forms is decreasing. Therefore, what is needed is a mailing form configured for use with non-impact printers. However, by simply adapting the standard available technologies to produce forms which can be used with non-impact printers results in forms that do not have flexibility and the capability for efficient use with non-impact printers. For example, mailers produced by machine-fold and seal technologies available in the 1980s and 1990s were often burdensome or clumsy to open. A perforated strip had to be removed from at least three, and sometimes four, sides of the mail piece. At least two of these strips ran at right angles to the paper grain whereby perforations are least effective for providing a clean tear.

A number of different types of forms include flaps or pockets provided in a closed configuration which must be opened at a later time. See, for example, U.S. Pat. No. 5,633,071, issued to Moore Business Forms, Inc. However, this patent describes a form having the disadvantage of not providing Information Based Indicia (IBI) or showing of a Facing Indicating mark (FIM) per the requirements of the United States Postal Service (USPS). Other forms which provide an outgoing mailer containing a report or payroll check required at least two sheets or plies or have further disadvantages which are overcome by the subject invention.

Furthermore, such forms often must be processed through automatic folding/sealing machines to be used in a practical manner. Such automatic folding machines are other examples of equipment not available to many small business organizations. Additionally, recipients of the prior-available forms usually do not read opening instructions printed on the exterior of the envelope. This resulted in frustration on the part of the recipient as well as damage or destruction of the contents of the envelope. This is especially problematic when the contents include a check.

Later variations of these mailers resulted in the "Z" fold configuration. This feature allowed for easier opening of the mail piece but did not visually indicate if the glue had been defeated, thus, the piece opened and re-sealed. Also, this variation still required tearing narrow strips left and right.

None of these previous embodiments described above allowed for printing of PC postage on a simplex printer. Each PC postage indicia is unique and therefore cannot be pre-printed.

Therefore, what is needed is a mailing form which is pre-folded and able to be machine-sealed. In using such an invention, the user would have an article suitable for mailing that is suitable for use with a simplex, non-impact printer, and can be easily processed, sealed and subsequently mailed.

The subject invention can provide a mailing form providing advantages that are absent from the currently available forms, including (1) providing a combination outgoing mailer envelope and financial document (e.g., a payment check) produced from a single ply of paper stock, (2) a machine-sealable mailer which protects the integrity of the document within, is easily opened and allows for convenient extraction of the contents, (3) a mailer which can be simplex printed to include all addressing, check information, and MICR encoding and electronic PC postage, including Information-Based Indicia (IBI) and FIM indicia and automatic positioning of same, in a single pass through the simplex printer, and (3) providing these in a form which can be sealed with a pressure-activated sealing means is therefore needed in the art.

SUMMARY OF THE INVENTION

In accordance with one aspect of the invention, there is provided a mailing form constructed of a single ply of substantially opaque or printable substrate material which is configured such that it can be folded to form a financial document, such as an accounts payable or payroll check and check voucher, and wherein the ply is further folded to form an outgoing mailer envelope in which the financial document is enclosed for mailing to a recipient. Preferably, this single ply of substantially opaque, or printable substrate material can be at least partially overlaid with a single ply of substantially transparent substrate material to provide windows which can be viewed or scanned therethrough. Furthermore, the current invention provides the additional feature of containing suitable adhesive such that the article can be sealed by utilizing applying pressure to the adhering plies. Certain features of this embodiment are described in related U.S. patent application Ser. No. 09/243,003, its parent, U.S. Pat. No. 5,865,717, U.S. patent application Ser. No. 09/488,067, and its parent application, U.S. patent application, Ser. No. 09/179,224, all of which are hereby incorporated by reference.

One general advantage of the subject invention is to provide a user with a form which is of a standard size for printing on a standard non-impact printer, but which is actually an oversized form which would not normally be printable on a standard non-impact printer. Another generally advantageous aspect of the subject invention is to provide a mailer which can be used for sending secured documents, i.e., a mailer having features which maintains the security for the contents, e.g., financial documents such as a check or tax document, contained within the mailer.

The mailer form of the subject invention is constructed from a single ply of substantially opaque or printable substrate material, such as paper stock commonly used in the industry, having standard width, e.g., 8½ inches and meeting banking and postal requirements. The length of the form should be long enough to provide separable sections of the form which can be folded in a manner to provide a front and back ply for an outgoing mailer envelope and a financial document, such as a standard check and voucher document, each of which are vertically aligned in the extended (pre-folded) configuration. Typically, then, the ply is about 20 to 21 inches in length (the width dimension in reference to the web) in its extended configuration.

The substrate ply includes perforation or score lines horizontally dividing the form into each of these sections and providing fold lines for folding each of the sections into the final folded configuration. One section of the outgoing mailer envelope preferably includes cut-out areas, or "windows" for viewing of address information and postage indicia printed on a corresponding face of the form which, when the form is folded to form the outgoing mailer envelope, mates with the inner face of the outgoing mailer envelope front ply to show through the windows. The inner face of the outgoing mailer envelope front ply also includes a transparent backing sheet to protect the contents contained within the mailer envelope or to provide efficient feeding of the form through a non-impact printer.

Additional features of the subject invention include the placement of pressure-activated adhesive which allow for the invention to be machine-sealed. Additional certain die-cuts which provide removable protective strips which, when removed, advantageously expose adhesive patternly disposed on the form for sealing the outgoing mailer envelope, and additional perforations providing tear-off strips which can facilitate folding of the form into a completed mailer or can facilitate opening of the sealed mailer by the recipient.

A further advantage provided by the subject invention includes a form which is manufactured and provided to the user in a unique, pre-folded configuration such that mailing information can be printed on a simplex, non-impact printer and the form further processed by the user to produce a mailer envelope having a financial document such as a check and voucher contained therewithin.

Still further, the subject invention can advantageously provide a form which can be sealed using a pressure-seal sealing mechanism, and which is used for sending secured documents, i.e., a mailer having features which maintains the security for the contents, e.g., financial documents such as a check or tax document, contained within the mailer.

In one novel embodiment, the invention comprises an L-shaped tear-away strip along two edges of the form as it is foldably configured. Removal of this L-shaped strip allows access to the document contents contained within the mailer. The contents are attached to the form via a perforation which can be defeated by pulling the contents, which can thereby be removed. Several variations of this embodiment are contemplated, including but not limited to providing different types of notches for accessing the contents. One type of access notch is a corner notch; another is a thumb notch. Yet another variation of this embodiment can include a top edge which is permanently glued together rather than folded over a facing ply to provide reinforcement and accurate and automatic positioning of the Facing Identification Mark (FIM).

Accordingly, providing a single form which includes a payment check or other financial document or information, and which can be folded to provide an outgoing mailer envelope, all printable in a single pass through a simplex, non-impact printer, can be advantageous by reducing labor and material expenses.

BRIEF DESCRIPTION OF THE DRAWINGS

Preferred embodiments of the subject invention are hereafter described with specific reference being made to the following figures.

DETAILED DESCRIPTION

The present invention concerns a one-way (non-response) mailer which can include a check or other financial documents. The subject invention, although generic in that it can be adapted for use with a variety of documents, can be preferably used to generate accounts payable and payroll checks for a plurality of recipients using a single inventory of forms. The subject invention is manufactured using appropriate check paper stock as a web approximately 20½ inches in width (form length). The web can then be printed with a pantograph if desired for use with financial documents which require security. A transparent backing sheet is adhered to a section of the web, which is then plow folded to a width approximately 14 inches in length.

The subject invention can be understood by reference to the accompanying drawings attached hereto and the description of the Figures.

Figure 1:
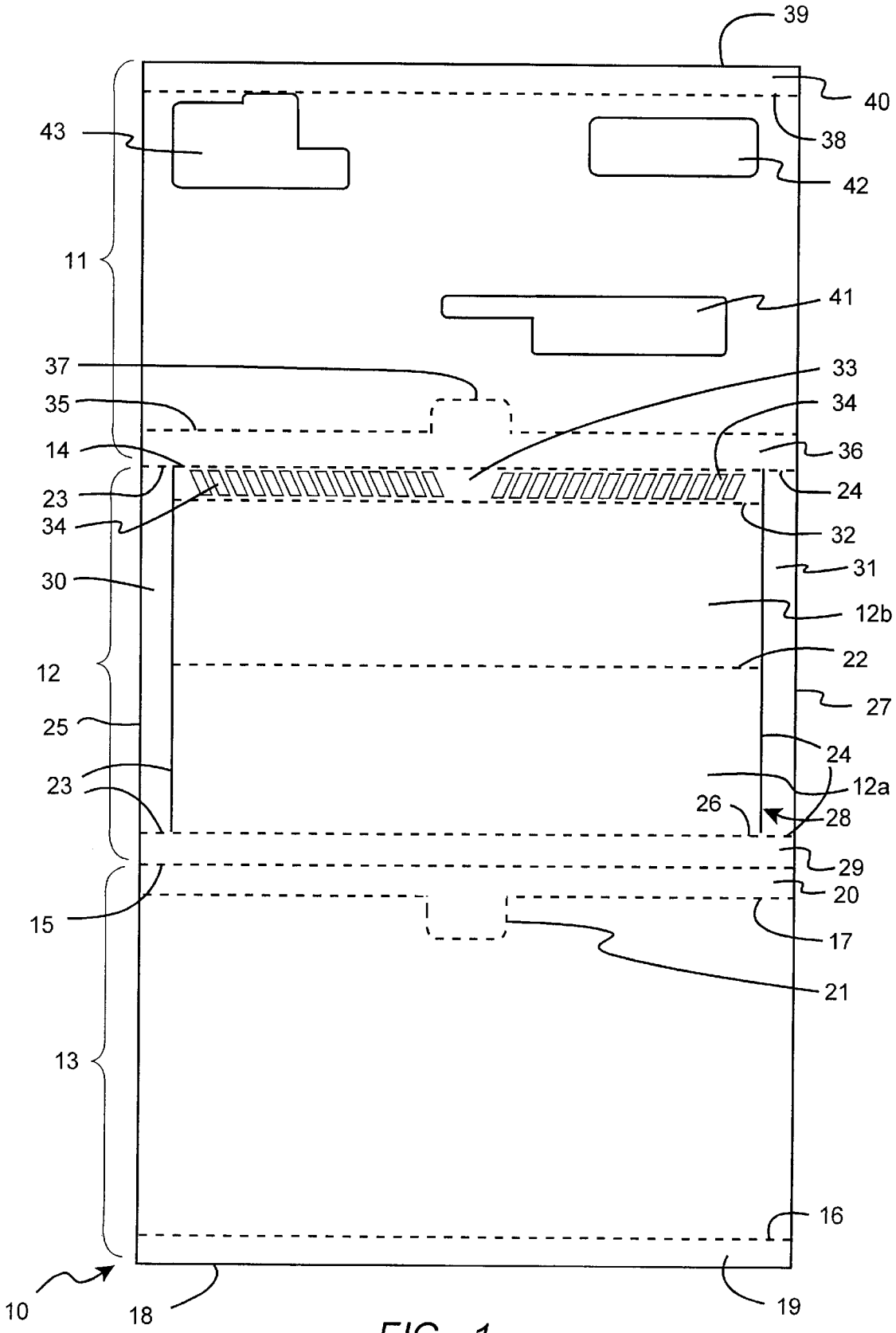
FIG. 1 is a plan view of a front face of the mailing form made in accordance with the present invention, showing die-cuts and perforations provided therein, which form the various features and sections of the form.

FIG. 1 shows a plan view of a front face of the mailing form 10 in its extended configuration. This front face is the face on which printed information can be provided by a single pass through a simplex, non-impact printer. This front face is therefore the interior portion of the outgoing mailer envelope and its contents. Mailing form 10 comprises mailer envelope front ply section 11, document section 12, and mailer envelope back ply section 13, vertically aligned with one another and divided from one another by horizontal perforations 14 and 15.

Mailer envelope back ply section 13 includes horizontal perforation 16 parallel to and approximately ¼ of an inch from end edge 18. This perforation provides extension strip 19 which allows printing of postage indicia flush with this perforation, avoiding a ¼ inch non-printable border left by most non-impact printers. Extension strip 19 is foldable along perforation 16 such that the postage indicia is within ⅛ inch or less from the top edge of the mailer envelope, as preferred by the United States Postal Service (USPS). Mailer envelope back ply section 13 also includes perforation 17, parallel to and approximately ¼–¾ of an inch from perforation 15. Removable tear-off strip 20 is thereby formed between perforations 15 and 17 and allows for removal of strip 20 by the recipient in opening the folded and sealed mailer envelope. In the preferred embodiment shown in FIG. 1, perforation 17 can be formed such that the perforated portion does not span the entire width of the form. Instead, perforation 17 includes a substantially "U"-shaped or "notched" die-cut 21 centrally formed therein to provide a tab in section 13 which can be removed when tear-off strip 20 is removed. Removal of this tab creates a "thumb notch" which can facilitate removal of contents of the mailer envelope by providing the recipient access to those contents using a thumb and/or finger.

Document section 12 provides an area for printing a document which can then be folded such that it is contained within the front and back ply sections of a folded mailer envelope. Preferably, section 12 can include a perforation 22 which divides section 12 in half, forming separable sections 12*a* and 12*b* of equal size and meeting applicable banking size requirements. It is desired to have these sections 12*a* and 12*b* separable from one another when the document section 12 is used, for example, to provide a check and voucher. One of sections 12*a* and 12*b* can be printed as the check, and the other of these sections can be printed as the detail listing or voucher. This perforation 22 also can facilitate folding by the user so that sections 12*a* and 12*b* can be folded over one another for containment within the mailer envelope. Because the mailing form 10 can be generic, i.e., allowing a variety of documents to be printed for use, perforation line 22 can be optional. When a perforation line 22 is not provided, however, a score or fold line is present to facilitate folding of section 12 by the user.

Perforation 26 is formed in document section 12 parallel and approximately ¼ to ¾ inches, preferably ⅜ inches, interior (relative to document section 12) to perforation 15. This perforation forms tear-off strip 29 which mates with tear-off strip 20 when the mailer envelope is folded and sealed. Tear-off strip 29 can be removed by the recipient, along with tear-off strip 20 when opening the mailer envelope.

Document section 12 further comprises die-cut 23 formed parallel and approximately ¼ to ¾, preferably ⅜, inches interior to side edge 25 of document section 12. This die-cut 23 is shown to continue perpendicular to the side edge 25 and contiguous with a portion of perforations 14 and 26 at each end of the die-cut. Similarly, die-cut 24 is formed parallel and approximately ¼ to ¾, preferably ⅜, inches interior to the opposite side edge 27 of document section 12, and also is shown to continue perpendicular to side edge 27 and contiguous with a portion of perforations 14 and 26. These die-cuts preferably have areas which are not completely cut, known in the art as paper "ties." These are illustrated as incomplete die-cut lines as shown, for example, in tie 28 in FIG. 1.

Die-cut 23 provides a removable "chip-out" area 30 which is automatically removed by the user prior to forming the mailer envelope. Advantageously, as described herein below, the chip-out area can be removable as part of a single action when removing the protective ring for exposing adhesive. Die-cut 24 provides a similar chip-out area 31 on the opposite edge of document section 12.

Document section 12 further comprises perforation 32 which is formed between die-cuts 23 and 24, parallel and approximately ¼ to ¾, preferably ⅜, inches interior (relative to section 12) to perforation 14. Between perforations 14 and 32 is formed a removable tear-off strip 33 in the front ply of the mailer envelope 11. This tear-off strip 33 corresponds to and mates with previously described tear-off strips 20 and 29 when the mailer envelope is folded and sealed. This removable tear-off strip 33 is also removed by the recipient in opening the mailer. Preferably, within this tear-off strip 33 are further provided a plurality of die-cut "voids" 34, which, when removed, expose adhesive disposed on a mated strip, allowing the adhesive to contact, through tear-off strip 33, another mated strip when the mailer envelope is folded and sealed. These voids are shown in FIG. 1 as a series of slanted die-cuts which is a preferred configuration for providing maximum exposure of adhesive while maintaining strength and integrity of the strip 33 during processing. It would be understood that a variety of other configurations, shapes, or sizes could be utilized for these cut-out areas which provide similar advantages.

Mailer envelope front ply section 11 comprises perforation 35, parallel to and approximately ¼ to ¾, preferably ⅜, inches interior (relative to section 11) to perforation 14. This perforation provides removable tear-off strip 36 which allows removal of strip 36 for opening the folded and sealed mailer envelope by the recipient. In the preferred embodiment shown in FIG. 1, perforation 35 can be formed such that the perforated portion does not span the entire width of the form. Instead, perforation 35 includes a substantially "U"-shaped, or "notched" die-cut 37 centrally formed therein to provide a removable tab in section 11 when tear-off strip 36 is removed. This tab can facilitate removal of contents of the mailer envelope by providing thumb and/or finger access to those contents by the recipient. This perforation 35 having "notched" area 37 is preferably formed as a mirror image to perforation 17 and notch area 21 such that they mate and form aligned perforation lines 17 and 35 on the respective back and front ply sections of the mailer envelope.

Mailer envelope front ply 11 further comprises perforation 38 parallel and approximately ½ to ¾ inches interior to top edge 39, forming therebetween a sealer flap 40 for the mailer envelope. Perforation 38 provides a fold line for folding over the sealer flap by the user when sealing the mailer envelope. Advantageously, the form provides for a mailer envelope which meets size requirements of the USPS. Currently, the USPS requires a mailer envelope to be 6⅛ inches or less in height. The subject invention is dimensioned such that it provides a mailer envelope which is 6 inches in height in its final folded and sealed configuration.

In addition, this mailer envelope front ply section 11 includes die-cut window areas 41, 42, and optionally, 43 which allow viewing of printed information therethrough when the mailer envelope is folded and sealed. Window 41 provides for viewing addressee (recipient) address information; window 42 provides for viewing return address (user address) information; and window area 43 provides for viewing of postal indicia. Window 41 is shown in its preferred configuration as a "stepped" window, i.e., wider in at least one dimension, to accommodate bar-coded information in accordance with certain USPS regulations. Similarly, window 43 is also shown in a preferred "stepped" configuration. The postage indicia window 43, however, is shown in a most preferred configuration having a stepped area in two dimensions. The stepped area which meets perforation 38 provides for a facing identification mark (FIM) to be positioned flush with the top edge of the mailer envelope (perforation 38, when folded and sealed). In addition, a second stepped area can be provided in a perpendicular direction to allow for a 2-dimensional bar-code to be printed. These configurations can be particularly advantageous for use with PC Postage.

Figure 2:
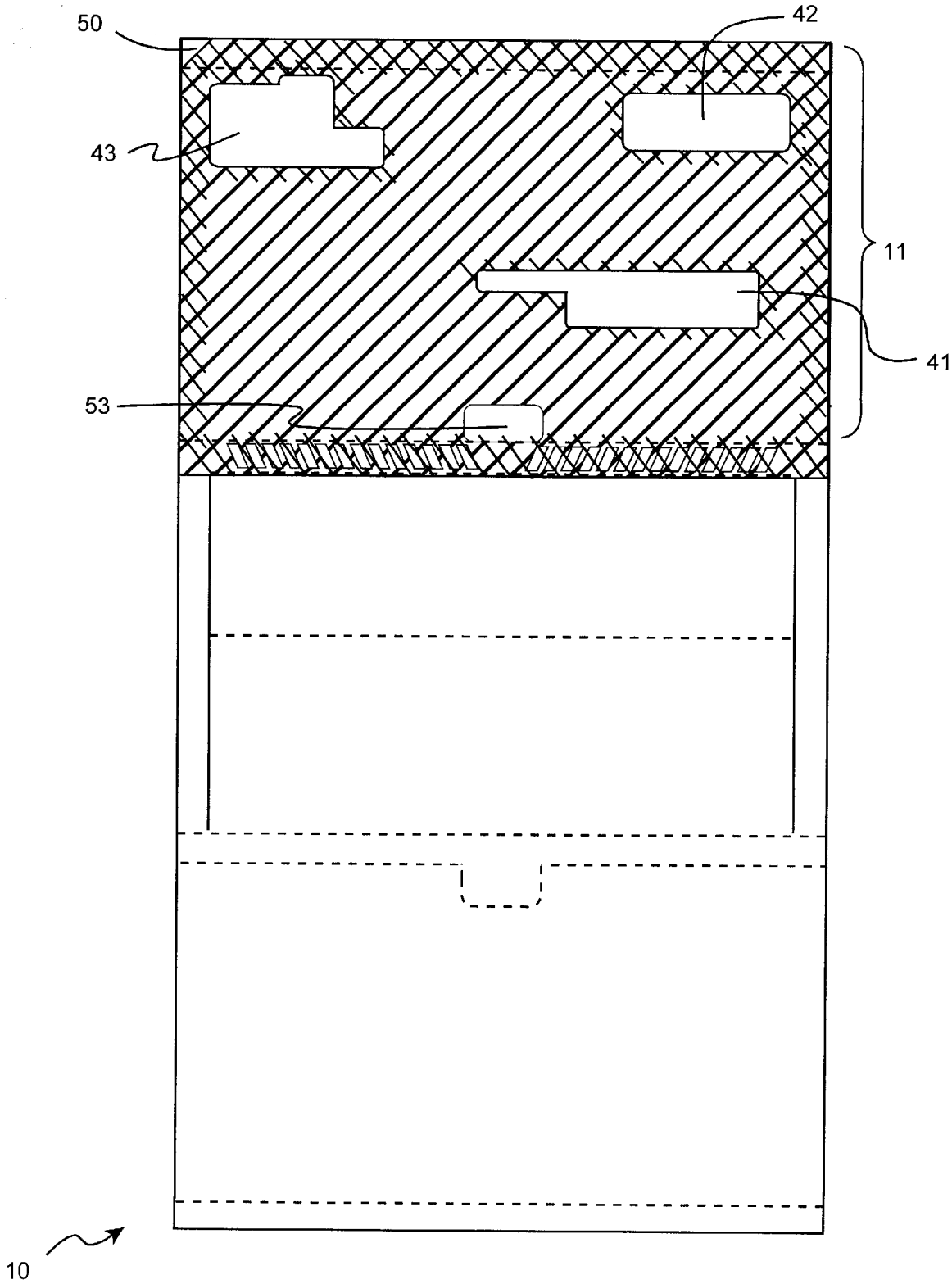
FIG. 2 is a plan view of a front face of the mailing form shown in FIG. 1, showing the various die-cuts and perforations provided in the form, and further illustrating the areas where adhesive is disposed thereon.

FIG. 2 is a plan view of a front face of the mailing form 10 shown in FIG. 1, showing the various die-cuts and perforations provided in the form, and further illustrating the areas where adhesive material (hatching) is disposed on the face of mailer envelope front ply section 11. The diagonal hatching is shown to illustrate that the adhesive can be patternly disposed, e.g., striatedly disposed, in order to provide effective adhesion with a minimal amount of adhesive applied. Cross-hatching is shown to illustrate the areas, e.g., around the perimeter edges of section 11 and around the window areas 41, 42, and 43 formed therein, where a solid coating of adhesive is preferred in order to provide a maximum bonding of the adhesive to prevent separation between the ply and an overlying transparent backing sheet. In addition, two areas are adhesive-free—a corner area 50 remains adhesive-free in order to facilitate removal of a portion of the transparent backing sheet, and tab area 51 remains adhesive-free in order to facilitate its removal by the recipient and to not adhere t the mailer envelope contents (document section 12).

Figure 3:
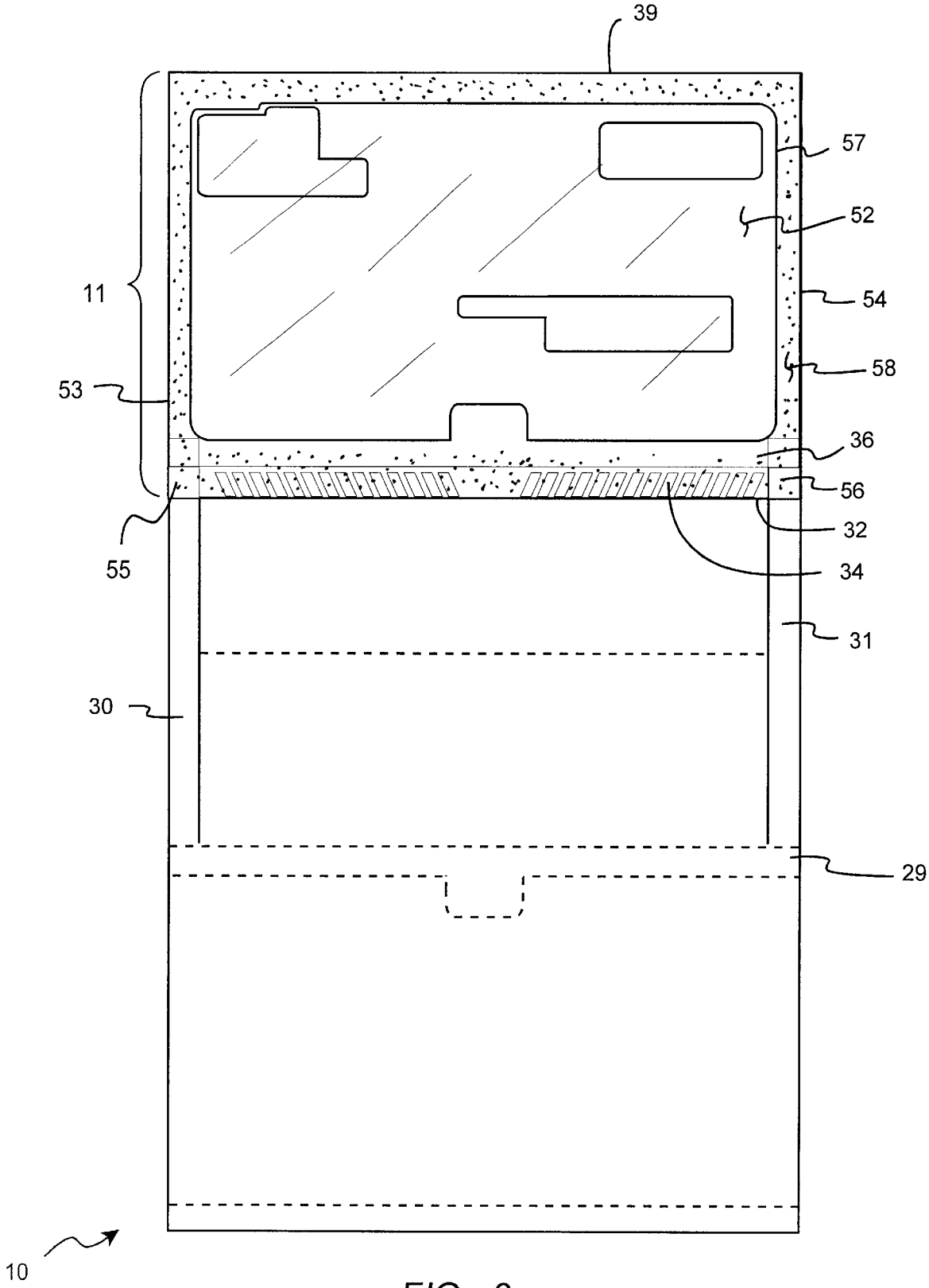
FIG. 3 is a plan view of a front face of the mailing form shown in FIG. 1, showing the various die-cuts and perforations provided in the form, and further illustrating the placement of a transparent backing sheet overlying the inner face of the section forming the front ply of the outgoing mailer envelope.

FIG. 3 is a plan view of a front face of the mailing form 10 shown in FIG. 1, showing the various die-cuts and perforations provided in the form, and further illustrating the placement of a transparent backing sheet 52, approximately 1 mil in thickness, overlying the inner face of the outgoing mailer envelope front ply section 11. Preferably, the transparent backing sheet is a static-free plastic or polymer material, which advantageously is heat-resistant and prevents static buildup when processed through a laser printer. The transparent backing sheet 52 preferably extends from top edge 39 to perforation line 32 and from respective side edges 52 and 53. FIG. 3 further illustrates a die-cut 57 formed around the interior perimeter edge of transparent backing sheet 52, forming a removable, substantially rectangular protective ring 58, which exposes adhesive on the front face of outgoing mailer envelope front ply section 11 when removed by-the user. Removal of the protective ring is facilitated by adhesive-release material (stippling) patternly disposed between the transparent backing sheet 52 and the adhesive disposed on section 11.

Within this protective ring area, adhesive-release material is not disposed in areas 55, 56, and in void areas 34 in order to allow contact of the adhesive disposed on outgoing mailer envelope front ply section 11 for adherence to the underlying paper stock. Accordingly, when the protective ring 58 is removed during use, void areas 34 are removed with the protective ring leaving open areas so that adhesive disposed in tear-off strip 36 contacts and adheres to its corresponding section 29 (back face) mated thereto when the mailer envelope is folded and sealed. In addition, the absence of release material at corner sections 55 and 56 allows for total adhesion of the transparent backing sheet 52 with chip-out areas 30 and 31. Therefore, removal of the protective ring 58 simultaneously removes these chip-out areas, and void areas 34, by a single action by the user, advantageously leaving the remaining portion of the transparent backing sheet 52 to protect the interior and contents of the mailer envelope. Adhesive-release material may also be avoided in the areas corresponding to the corner area 50 and tab 51 since no adhesive is disposed in these areas.

The adhesive and adhesive-release materials are well known in the art and are commercially available. Preferably, the adhesive is a permanent, pressure-seal adhesive. Silicon is commonly used in the industry for providing releasable bonding of adhesive and would be a preferred adhesive-release material. It would also be understood that the adhesive material would preferably be disposed such that a gap is provided approximately 1/32 to 1/64 inch along any edge to prevent oozing of the material.

Figure 4:
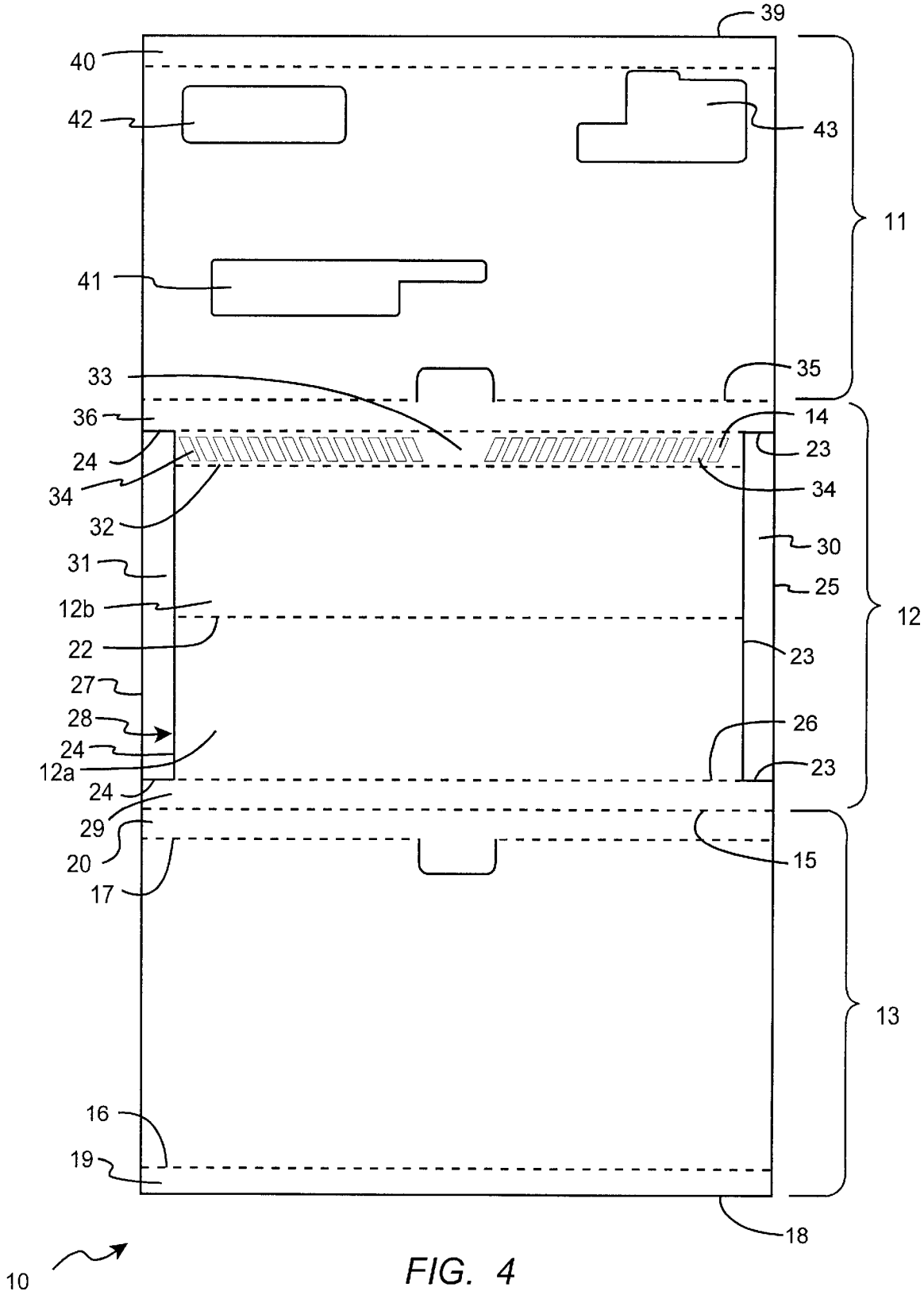
FIG. 4 is a plan view of a back face of the mailing form shown in FIG. 1, showing the various die-cuts and perforations provided therein, which form the various features and sections of the form.

FIG. 4 is a plan view of a back face of the mailing form 10 shown in FIG. 1, showing the various die-cuts and perforations provided therein, which form the various features and sections of the form. The back face is a mirror image of the front face of the form.

Once the form is manufactured, it can be pre-printed with instructions for use on any preferred face, e.g., on the back face of the back mailer envelope section 13. For security purposes, the inner faces of the mailer envelope can also be pre-printed with a pantograph to prevent viewing of the contents within the envelope. A security pantograph can also be printed on the document section to prevent alteration or other manipulation of the document. A printed pantograph is illustrated in FIG. 6.

Figure 5:
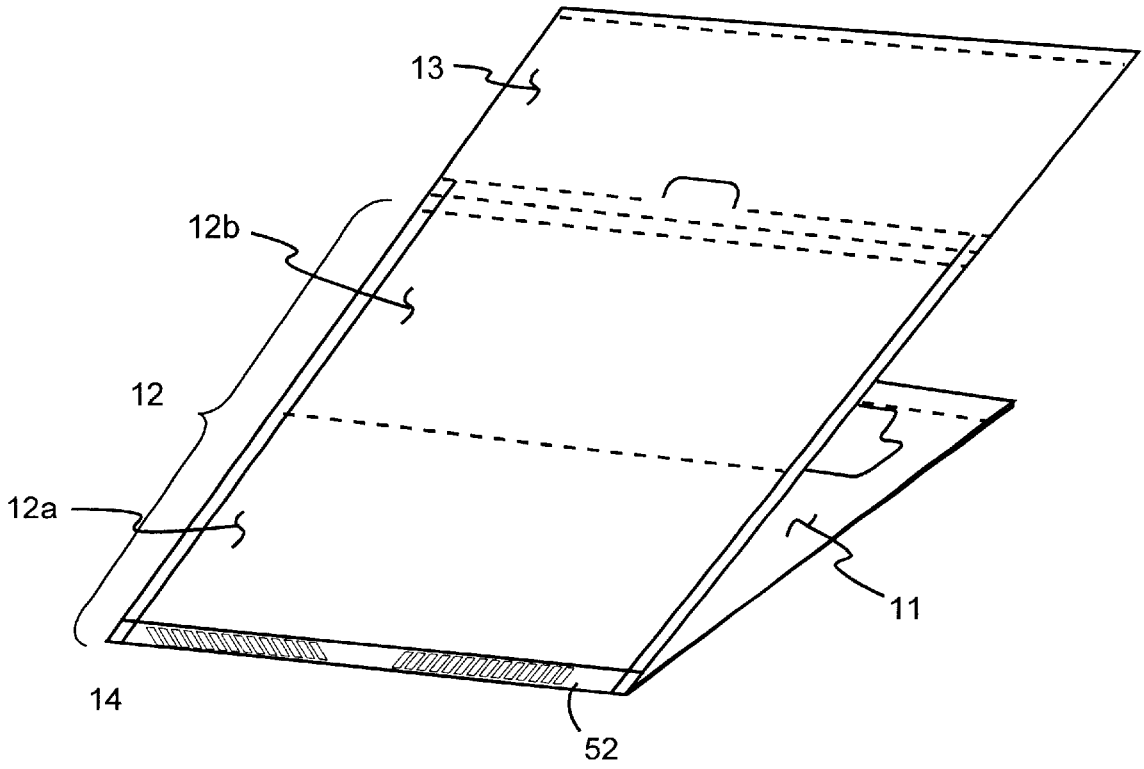
FIG. 5 shows the form in a pre-folded configuration as preferably provided to the user.

Referring to FIG. 5, the manufactured form is preferably plow-folded along perforation 14 whereby the back face of mailer envelope front ply section 11 is plow-folded to meet and contact the back face of document section 12. The form is preferably provided to the user in this configuration, wherein the transparent backing sheet 52 overlying perforation 14 provides a leading edge of the form for feeding through a simplex, non-impact printer. This plow-fold results in a form approximately 14 inches in length, and having mailer envelope front ply section 11 is attached only along the fold line 14, allowing section 11 to freely hang in relation to the rest of the form. The inventor refers to this configuration as a "hanging tail" configuration. For use in certain printers, e.g., a laser printer, it is preferred to include a matte varnish coating along at least one face of the leading edge of the transparent sheet 52 to provide adequate surface friction and facilitate feeding of the form through the feeder mechanism of the printer.

The form in this hanging tail configuration can then be printed by the user wherein the voucher information and recipient address information is printed on the printing (front) face of document section 12*a*, the check or other information is printed in the appropriate area of the printing (front) face of document section 12*b*, and return address information and PC Postage indicia are printed in the appropriate areas of the printing (front) face of mailer envelope back ply section 13. Appropriate positioning of the information on each of these sections can be achieved using available software, or by adapting available software for such purposes.

Figure 6:
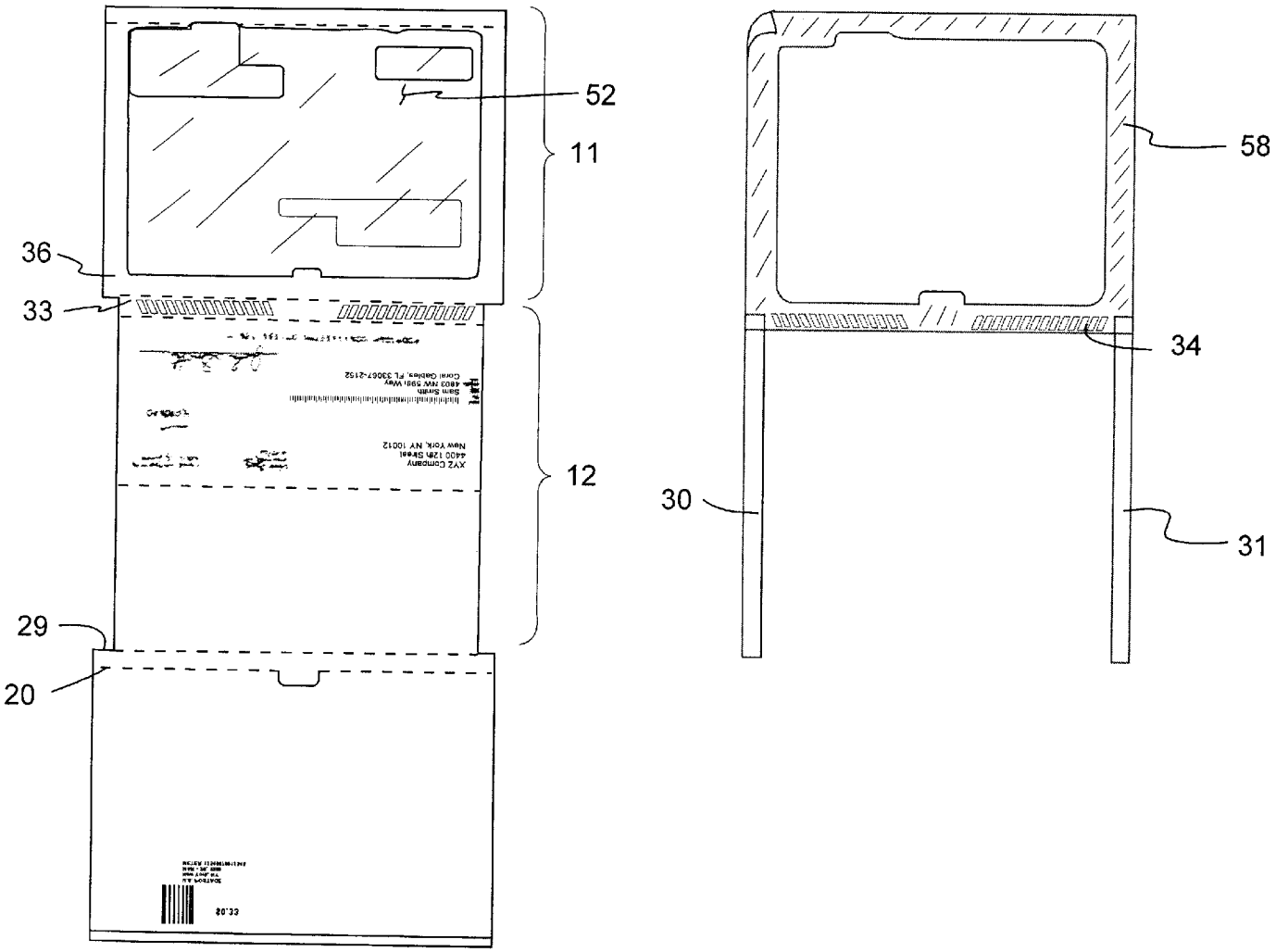
FIG. 6 shows a printed form, having edge strips removed, and further illustrating a pantograph for security of the form and document contained therein.

As shown in FIG. 6, once printed by the non-impact printer, mailer envelope top ply section 11 can be unfolded such that the form is in its completely extended configuration. Protective ring 58 is then removed, simultaneously removing void areas 34 and edge strips 30 and 31. The removal of edge strips 30 and 31 advantageously provides for a freely enclosed document section 12, which can be easily removed from within the mailer envelope after end tear-off strips 20, 29, 33, and 36 are removed.

Figure 7:
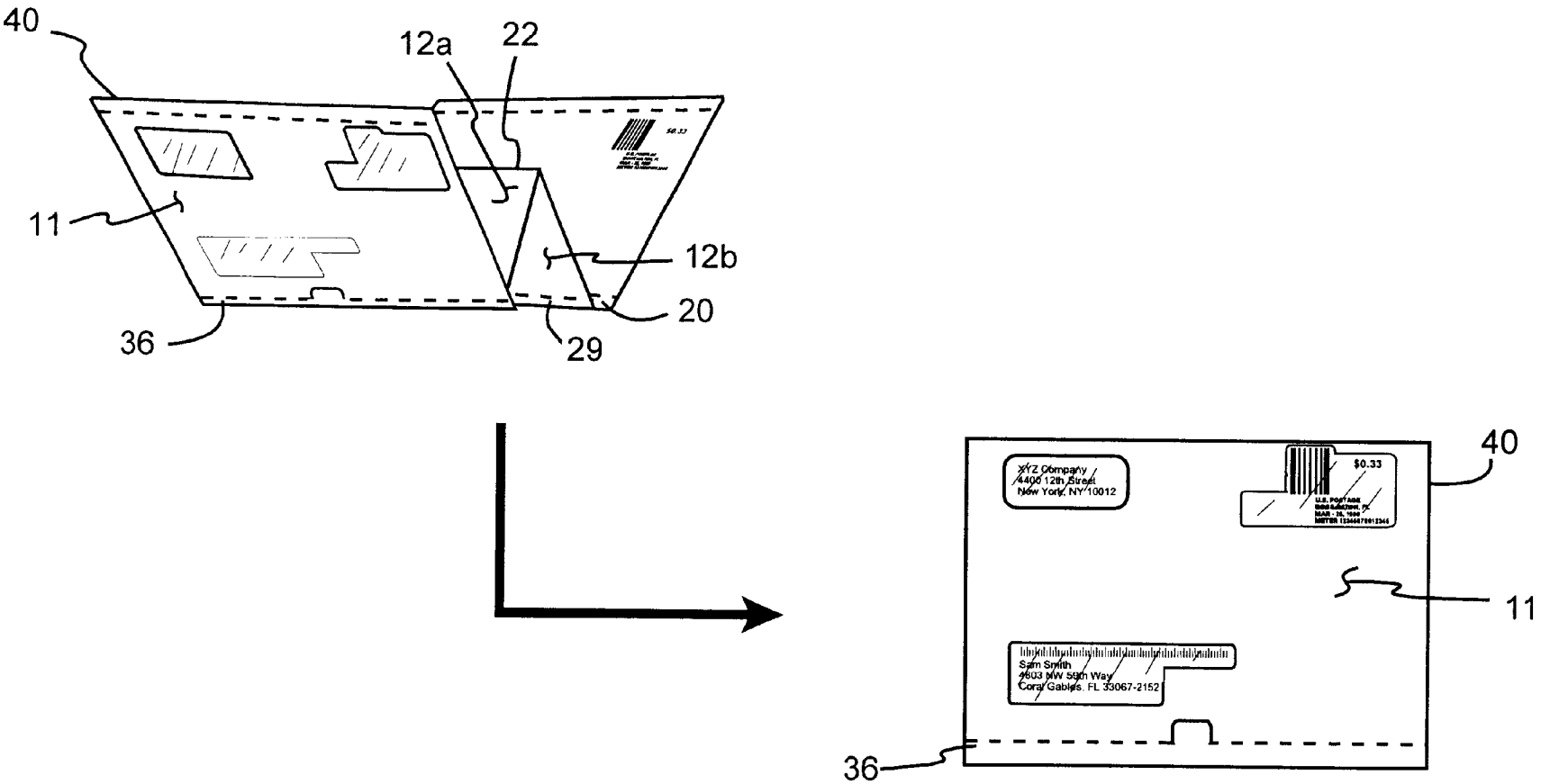
FIG. 7 illustrates, is a step-wise fashion, the steps for folding and sealing procedure by the user.

The steps for folding and sealing of the form by the user are illustrated in FIG. 7. The form can be folded along perforation 22, such that document sections 12*a* and 12*b* contact one another at their respective back faces. The mailer envelope front and back ply sections are folded inwardly along perforations 14 and 15 such that document section 12 is nested within the mailer envelope sections 11 and 13. The mailer envelope therefore is four plies thick (superimposed tear-off strips 20, 29, 33, and 36) at its bottom edge when in its final folded configuration.

Adhesive exposed on mailer envelope section 11 by removal of protective ring 58 can then contact each of the side edges of the corresponding face of mailer envelope section 13 for forming a seal at the side edges of the envelope formed thereby. Adhesive exposed on seal flap 40 at the top edge of mailer envelope section 11 is used to contact the back face of mailer envelope back ply section 13 to seal the envelope. Significantly, adhesive exposed on tear-off strip 36 is allowed to contact the back face of tear-off strip 29, through the removed void areas 34. Thus, mailer envelope form 10, in its folded configuration, is sealed around its entire perimeter and can be sent to the recipient.

Figure 8:
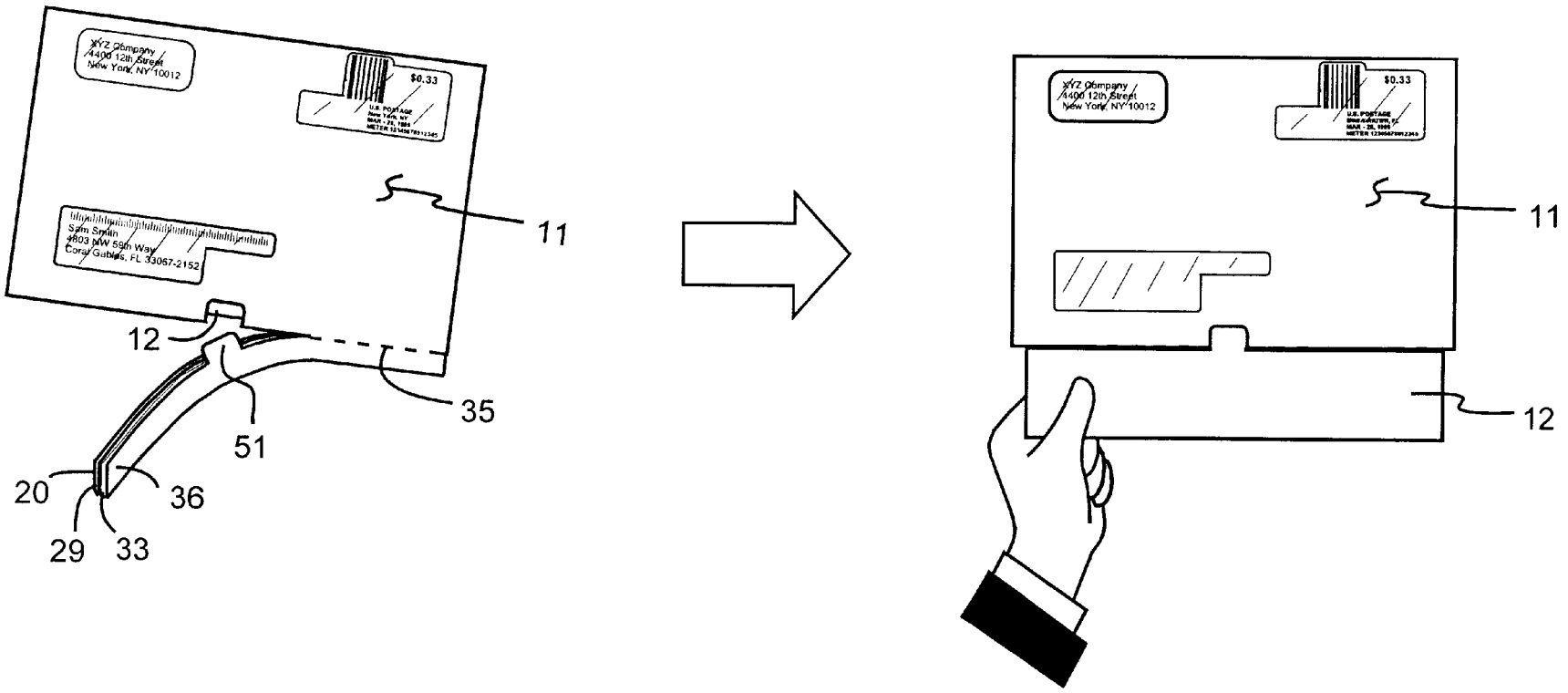
FIG. 8 illustrates, in step-wise fashion, the steps for opening of the mailer and accessing the contents of the mailer by the recipient.

The steps for opening of the mailer and accessing the enclosed document by the recipient are illustrated in FIG. 8. When the mailer is received by the recipient, all four superimposed plies of tear-off strips 20, 29, 33, and 36 can be removed simultaneously by tearing along perforations 35, 32, 26, and 17, which are also superimposed in the folded and sealed configuration. Removal of these tear-off strips also separates the document section 12 from the sealed mailer envelope and removes tab 51 and its corresponding tab on the mailer envelope back section 13. Thus, document section 12 is freely contained within the mailer envelope and can be easily removed by accessing the document section 12 via the removed tab area 51. Removal of the document section 12 by the recipient allows the recipient to then separate document sections 12*a* from 12*b*.

Figure 9:
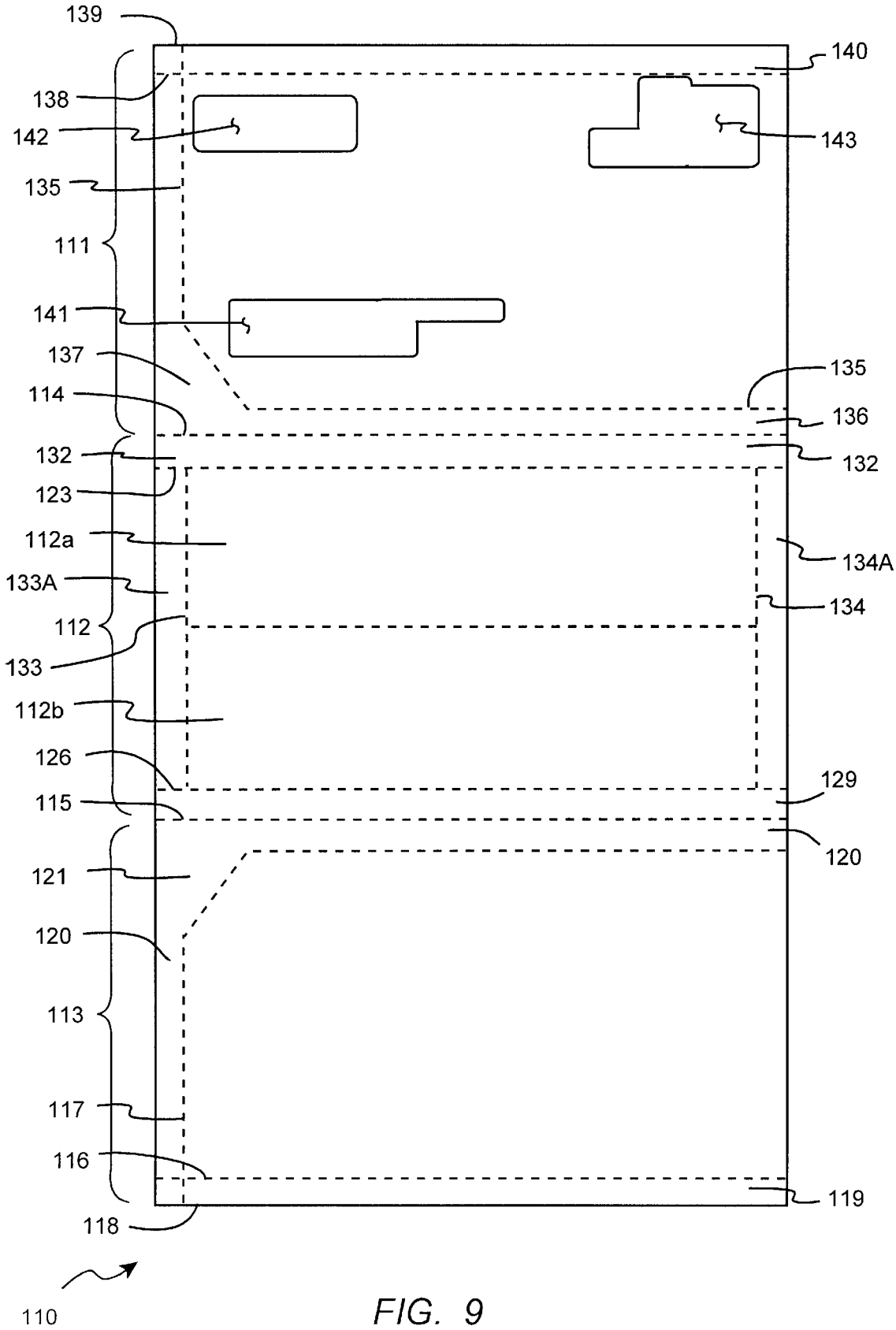
FIG. 9 is a plan view of a front face of a corner-notch variation of a further embodiment of the mailer form made in accordance with the present invention, showing die-cuts and perforations provided therein, which form the various features and sections of the form.

FIG. 9 shows a plan view of a front face of the mailing form 110 in its extended configuration. This front face is the face on which printed information can be provided by a single pass through a simplex, non-impact printer when the document is in the initial folded configuration for printing (see FIG. 14A and accompanying description provided herein). This front face therefore comprises the interior portion of the outgoing mailer envelope and the contents of the outgoing mailer envelope. Mailing form 110 comprises mailer envelope front ply section 111, document section 112, and mailer envelope back ply section 113, vertically aligned with one another and divided from one another by horizontal perforations 114 and 115.

Mailer envelope back ply section 113 includes optional horizontal perforation 116 parallel to and approximately ¼ of an inch from end edge 118. Extension strip 119 is thereby formed between perforation 116 and end edge 118. This extension strip 119 is folded over at perforation 116 in the folded and sealed configuration. In this way, the FIM can be printed within ¼ inch of end edge 118 (and preferably flush with perforation 116) so that it is automatically and accurately positioned flush with the top edge 138 (and viewable and scannable through window 143) when the mailer is in its folded and sealed configuration. Mailer envelope back ply section 113 also includes perforation 117, which forms an L-shaped tear-away or tear-off strip 120 along two edges of back ply section 113. Therefore, perforation 117 is formed parallel to and approximately ¼–¾ of an inch from perforation 115, and continues along a perpendicular edge of the form. Perforation 117 thereby allows for removal of strip 120 by the recipient in opening the folded and sealed mailer envelope.

Document section 112 provides an area for printing a document, which can then be folded such that it is contained within the front and back ply sections 111 and 113 of a folded mailer envelope. Preferably, section 112 can include a perforation 122, which divides section 112 in half, forming separable sections 112*a* and 112*b* of equal size and meeting applicable banking size requirements. This perforation 122 also provides a fold line for folding the document into a "W" fold configuration. This novel "W" fold configuration is so-called due to the shape of the document when viewed from a side edge, wherein each of the four parts of the document are folded to form a leg of the letter "W." It is desired to have these sections 112*a* and 112*b* separable from one another by the recipient along perforation 122 when the document section 112 is used, for example, to provide a check and voucher. One of sections 112*a* and 112*b* can be printed as the check, and the other of these sections can be printed as the detail listing or voucher so long as the addressee address information is printed on section 112*a* in order to be viewed or scanned through window 141 of section 111. This perforation 122 also can facilitate folding so that sections 112*a* and 112*b* can be folded over one another for containment within the mailer envelope. Because the mailing form 110 can be generic, i.e., allowing a variety of documents to be printed on a simplex printer, perforation line 122 can be optional. When a perforation line 122 is not provided, however, a score or fold line is present to facilitate folding of section 112 consistent with a "W" folded document.

Perforation 126 is formed in document section 112 parallel and approximately ¼ to ¾ inches, preferably ⅜ inches, interior (relative to document section 112) to perforation 115. This perforation forms strip 129 which mates with and is adhered to a portion of strip 120 when the mailer envelope is folded and sealed. Tear-off strip 129 can be removed by the recipient, along with strip 120 when opening the mailer envelope. In this variation of the embodiment having an L-shaped and removable strip, the perpendicular perforation 117 is adjoined by a diagonal perforation or die cut forming a corner notch 121 such that the removal of the strip 120 provides access to the contents of the mailer by the recipient.

Document section 112 further comprises perforation 123 formed parallel and approximately ¼ to ¾, preferably ⅜, inches interior to perforation 114, and continues across the entire width of document section 112, forming tear-off strip 132. This face of tear-off strip 132, in the folded configuration of the mailer, is mated with and adhered to tear-off strip 136 described below.

Document section 112 further comprises perforations 133 and 134 which are formed parallel and approximately ¼ to ¾, preferably ⅜, inches interior to each respective side edge of document section 112. Perforation 133 forms tear-off strip 133A which, in folded configuration, mates to side tear-off strip 136 of front ply section 111 and side tear-off strip 120 of back ply section 113. Perforation 134, which preferably can be a line of weakening formed by a die-cut having "ties" formed therein, provides side strip 134A, which remains as part of the mailer when document section 112 is removed by the recipient.

Mailer envelope front ply section 111 comprises perforation 135, which forms an L-shaped tear-away or tear-off strip 136 along two edges of front ply section 111. Therefore, perforation 135 is formed parallel to and approximately ¼–¾ of an inch from perforation 114, and continues vertically along one perpendicular edge of the form. Perforation 135 thereby allows for removal of strip 136 by the recipient in opening the folded and sealed mailer envelope.

Mailer envelope front ply 111 further comprises perforation 138 parallel and approximately ½ to ¾ inches interior to top edge 139, forming therebetween a sealer flap 140 for the mailer envelope. Perforation 138 can provide a fold line which mates with fold line 116 such that sealer flap 140 folds over extension strip 119 when the form is in its folded and sealed configuration. This extension strip 119 allows printing of postage indicia flush with this perforation, and thus the edge of the form, avoiding a ¼ to ⅜ inch non-printable border left by most non-impact printers. It is required by the USPS that postage indicia is within ⅛ inch or less from the top edge of the mailer envelope.

In addition, this mailer envelope front ply section 111 includes die-cut window areas 141, 142, and optionally, 143 which allow viewing of printed information therethrough when the mailer envelope is folded and sealed. Front ply section 111 can optionally be layered with a substantially transparent ply for protection of the mailer document contents, as previously described herein for other embodiments, and illustrated, for example, by the embodiment shown in FIG. 3.

Window 141 provides for viewing and scanning addressee (recipient) address information; window 142 provides for viewing return address (user address) information; and window area 143 provides for viewing of postal indicia. Window 141 is shown in its preferred configuration as a "stepped" window, i.e., wider in at least one dimension, to accommodate bar-coded information in accordance with certain USPS regulations. Similarly, window 143 is also shown in a preferred "stepped" configuration. The postage indicia window 143, however, is shown in a most preferred configuration having a stepped area in two dimensions. The stepped area which meets perforation 138 provides for a facing identification mark (FIM) to be positioned flush with the top edge of the mailer envelope (perforation 138, when folded and sealed). In addition, a second stepped area can be provided in a perpendicular direction to allow for a 2-dimensional bar code to be printed. These configurations can be particularly advantageous for use with PC Postage.

Figure 10:
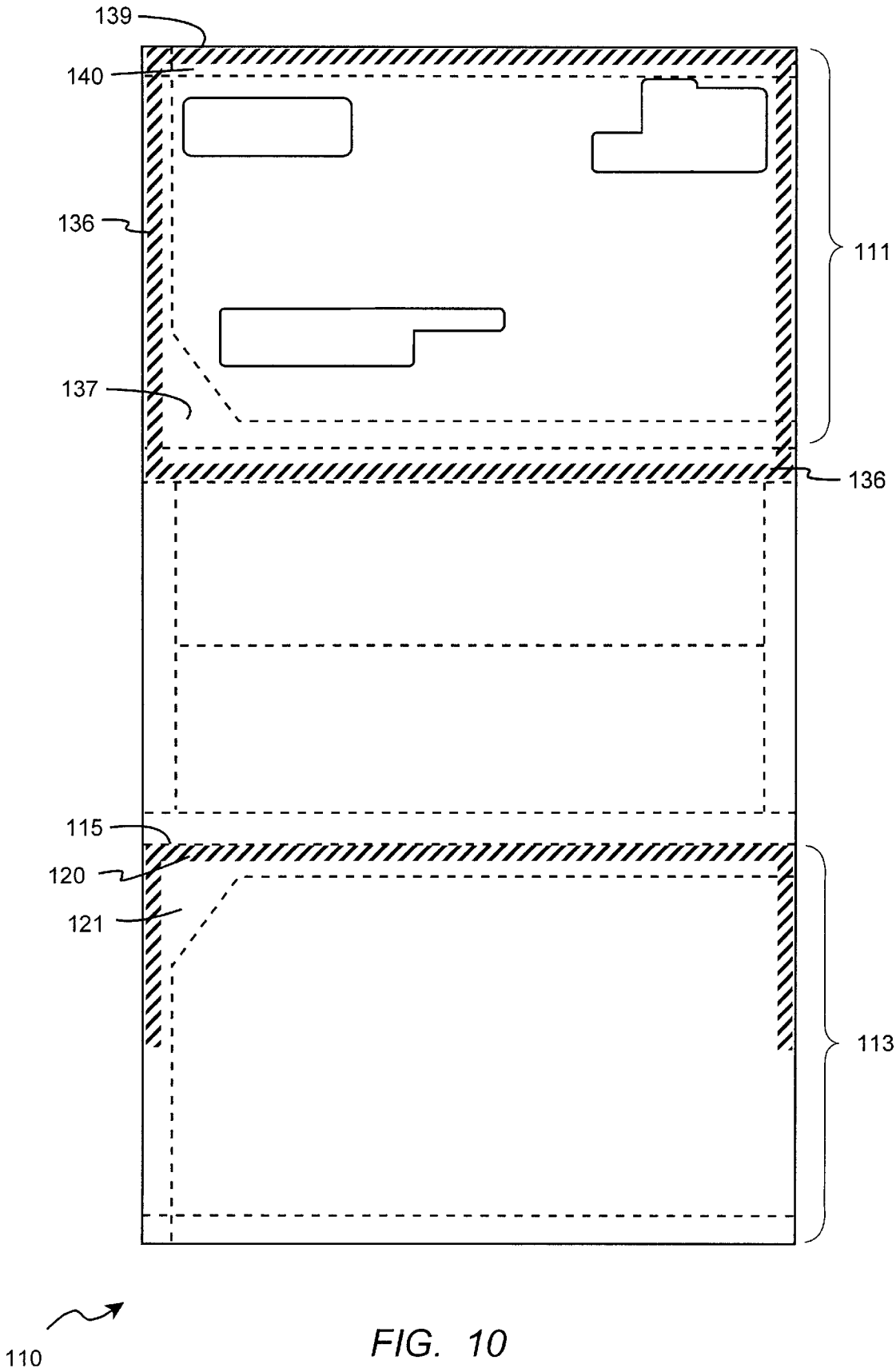
FIG. 10 is a plan view of a front face of the mailer as shown in FIG. 9, illustrating areas of disposed adhesive.

FIG. 10 is the same view of the front face of form 110 as shown in FIG. 9, but illustrates the position of adhesive materials, including co-adhesive, disposed thereon in order to provide an adhesive seal around the entire perimeter edge of the mailer. Adhesive (shown as hatching), which is preferably a pressure-seal or pressure-activated adhesive, can be disposed on tear-off strip 136 of front ply section 111 such that a portion of notched area 137 remains adhesive-free, allowing corresponding corners of document section 112 to not adhere and thereby be exposed when L-shaped tear-off strip 136 is removed. Adhesive is also preferably disposed along both edges opposite each leg of the L-shaped tear-off strip 136. Preferably, the adhesive disposed along top edge 139 is disposed only about half the width of strip 140. This adhesive can be pressure-seal, pressure-activated, or re-moistenable adhesive, as is well known in the art.

In addition, to form a completely sealed mailer, pressure seal or pressure-activated adhesive can be disposed on edges of back ply section 113. Preferably, the adhesive is disposed substantially on all of the portion of tear-off strip 120 parallel to perforation 115, and then extends about half way along the vertical side edges perpendicular thereto. Again, an adhesive free area is left remaining on notch area 121 to provide non-adherence to document section 112.

Co-adhesive material, which mates to and thereby forms a seal with the adhesive material (shown as stippling), can be disposed onto the face of the form in a position opposing the adhesive. Accordingly, in this embodiment variation, co-adhesive is shown disposed on around the entire perimeter edges of section 112 and on the remaining perimeter edge of section 113 where adhesive is not disposed.

It would be readily understood by persons of ordinary skill in the art that any disposed adhesive can be disposed as shown, or on any mated section of the mailer in order to completely seal the mailer. In other words, wherever adhesive is shown as being disposed, a co-adhesive can be disposed thereon in place of the adhesive, so long as all mated sections have an adhesive/co-adhesive material which mate to one another.

Figure 11:
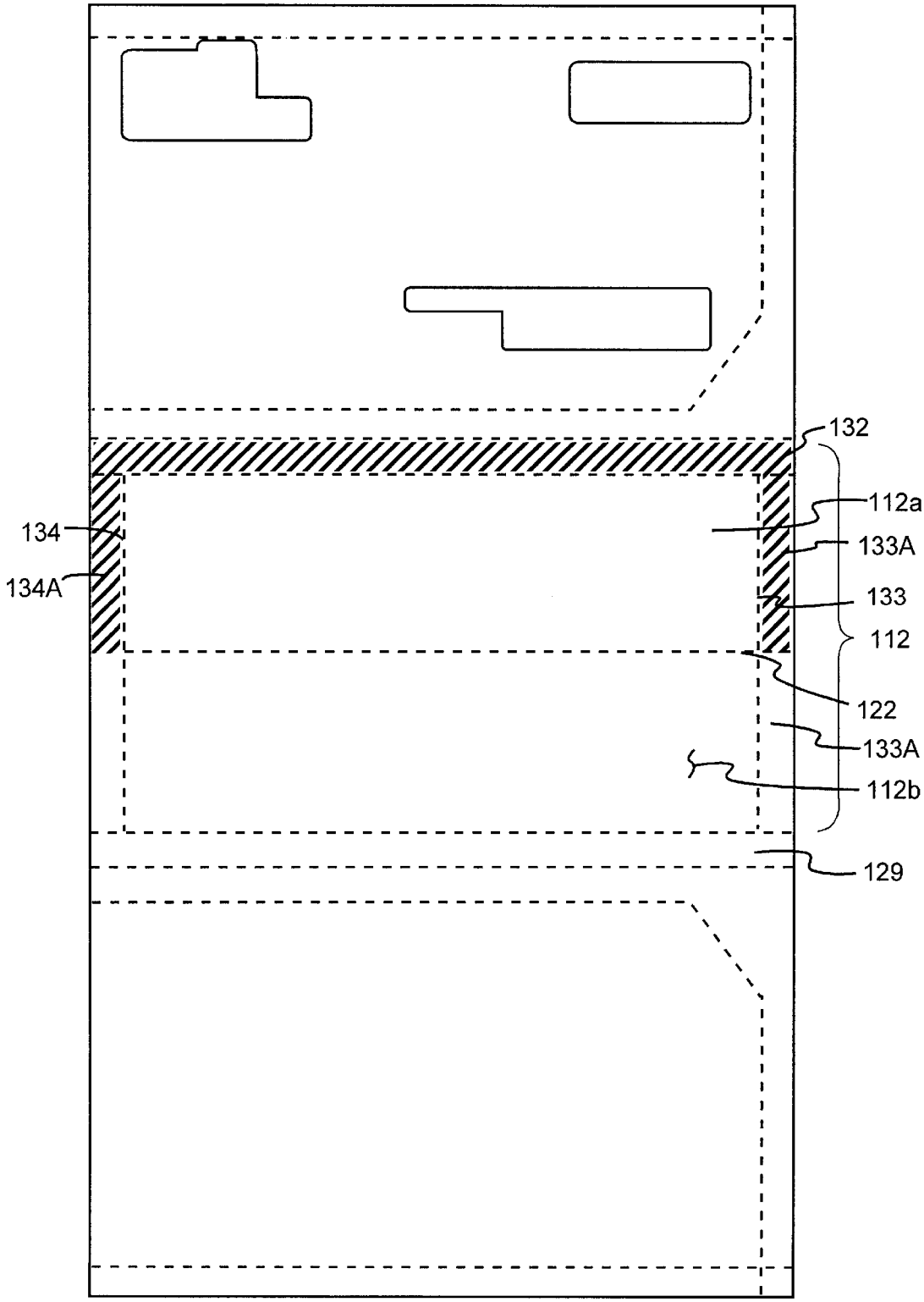
FIG. 11 is a plan view of a back face of the mailer as shown in FIG. 9, illustrating areas of disposed adhesive.
Figure 11:
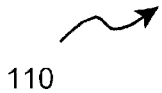

FIG. 11 is a plan view of a back face of mailer 110, showing areas where adhesive can be disposed in order to completely seal the outgoing mailer after or during folding. Preferably, a pressure-seal or pressure-activated adhesive can be disposed along certain edge strips of document section 112, and most preferably along tear-off strip 132 and its contiguous side strips 133A and 134A of document section 112*a*. This disposed adhesive can then mate with corresponding areas on document section 112*b* which have co-adhesive material disposed thereon, when in its folded configuration. Thus, in this variation of the present embodiment, co-adhesive is disposed on areas 134A, 133A, and 129 of section 112*b*. In addition, a strip of co-adhesive can be disposed on section 113, along perforation 116 in order to mate with the adhesive disposed onto the inner face of tear-off strip 114 when this strip is folded over to seal the outgoing envelope. Again, as would be understood in the art, adhesive can alternatively be disposed on the mated areas or in a mated pattern such that the mailer is completely sealed around its perimeter in its folded configuration (e.g., adhesive disposed on the remainder of side strips 133A and 134A, and tear-off strip 129).

Figure 12:
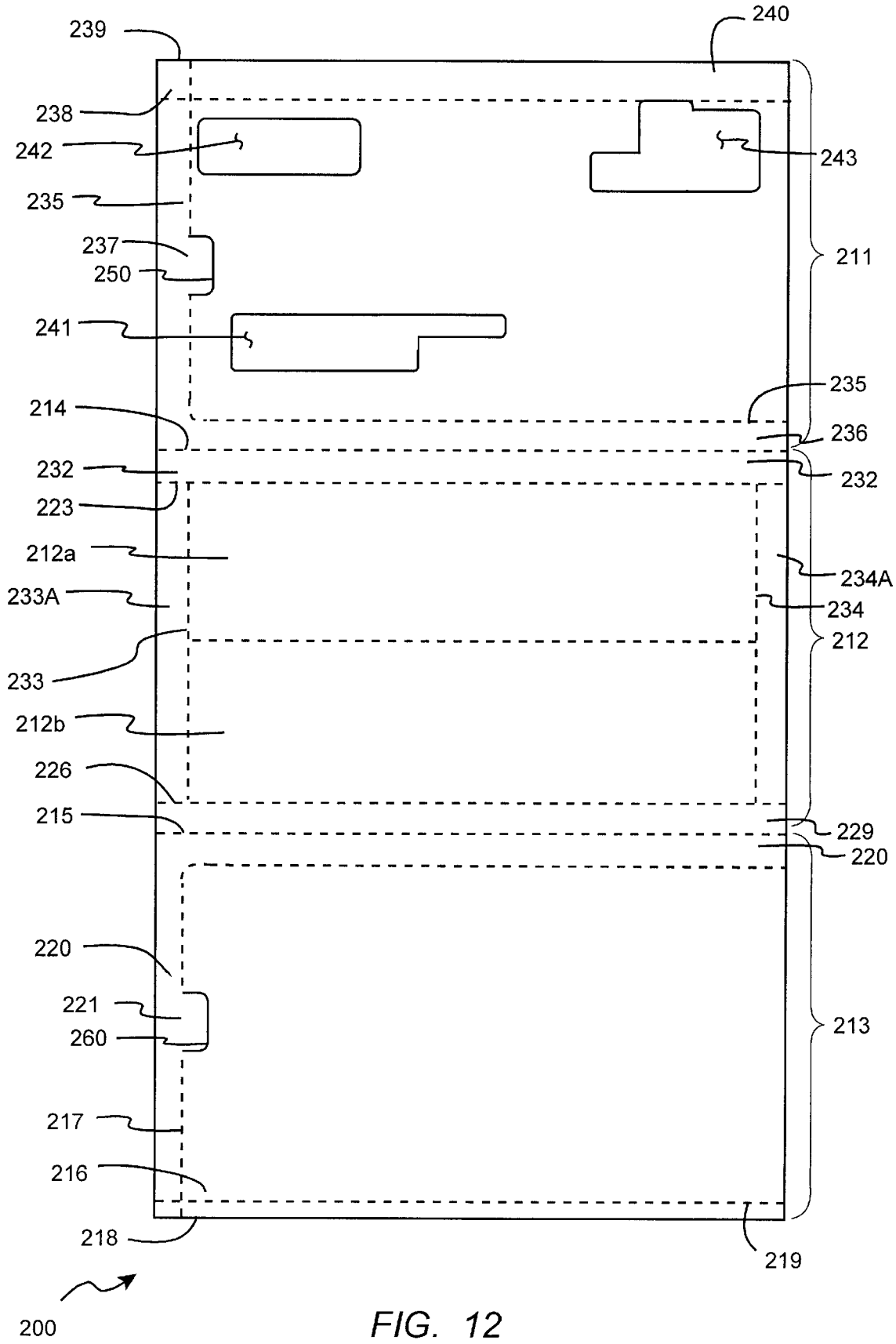
FIG. 12 is a plan view of a front face of a thumb-notch variation of the embodiment of the mailer as shown in FIG. 9, showing die-cuts and perforations provided therein, which form the various features and sections of the form and additionally showing a thumb notch for removing the enclosed document.

FIG. 12 is a plan view of a front face of mailer form 200, which is a variant of the mailing form 110 shown in FIG. 9. This front face is the face on which printed information can be provided by a single pass through a simplex, non-impact printer when the document is in the initial folded configuration for printing. Mailer form 200 comprises thumb-notch areas 221 and 237 rather than diagonal notches 121 and 137 of mailer 110 shown in FIGS. 9–11. These thumb notch areas formed in mailer 200 are substantially "U"-shaped die-cuts 250 and 260 centrally formed in vertical perforations 235 and 217 of front and back ply sections 211 and 213, respectively, and provide a removable tab when the L-shaped strip is removed by the recipient to open the mailer. This tab, which creates a "thumb notch", can facilitate removal of contents of the mailer envelope by providing thumb and/or finger access to the contents of the mailer envelope by the thumb and/or finger of the recipient. The die-cuts 250 and 260 are preferably formed as a mirror images in sections 211 and 213 such that they mate and form aligned die-cuts on the respective front and back ply sections of the mailer envelope when in its folded and sealed configuration.

Referring more specifically to FIG. 12, mailing form variation 200 comprises mailer envelope front ply section 211, document section 212, and mailer envelope back ply section 213, vertically aligned with one another and divided from one another by horizontal perforations 214 and 215;

Mailer envelope back ply section 213 includes optional horizontal perforation 216 parallel to and approximately ¼ of an inch from end edge 218. Extension strip 219 is thereby formed between perforation 216 and end edge 218. This extension strip 219 is folded over at perforation 216 in the folded and sealed configuration. In this way, the FIM can be printed within ¼ inch of end edge 118 (and preferably flush with perforation 216) so that it is automatically and accurately positioned flush with the top edge 238 (and viewable and scannable through window 243) when the mailer is in its folded and sealed configuration. Mailer envelope back ply section 213 also includes perforation 217, which forms an L-shaped tear-away or tear-off strip 220 along two edges of back ply section 213. Therefore, perforation 217 is formed parallel to and approximately ¼–¾ of an inch from perforation 215, and continues along a perpendicular edge of the form. Perforation 217 thereby allows for removal of strip 220 by the recipient in opening the folded and sealed mailer envelope.

Document section 212 provides an area for printing a document, which can then be folded such that it is contained within the front and back ply sections 211 and 213 of a folded mailer envelope. Preferably, section 212 can include a perforation 222, which divides section 212 in half, forming separable sections 212*a* and 212*b* of equal size and meeting applicable banking size requirements. This perforation 222 also provides a fold line for folding the document into a "W" fold configuration. This novel "W" fold configuration is so-called due to the shape of the document when viewed from a side edge, wherein each of the four parts of the document are folded to form a leg of the letter "W." It is desired to have these sections 212*a* and 212*b* separable from one another by the recipient along perforation 222 when the document section 212 is used, for example, to provide a check and voucher. One of sections 212*a* and 212*b* can be printed as the check, and the other of these sections can be printed as the detail listing or voucher so long as the addressee address information is printed on section 212*a* in order to be viewed or scanned through window 241 of section 211. This perforation 222 also can facilitate folding so that sections 212*a* and 212*b* can be folded over one another for containment within the mailer envelope. Because the mailing form 210 can be generic, i.e., allowing a variety of documents to be printed on a simplex printer, perforation line 222 can be optional. When a perforation line 222 is not provided, however, a score or fold line is present to facilitate folding of section 212 consistent with a "W" folded document.

Perforation 226 is formed in document section 212 parallel and approximately ¼ to ¾ inches, preferably ⅜ inches, interior (relative to document section 212) to perforation 215. This perforation forms strip 229 which mates with and is adhered to a portion of strip 220 when the mailer envelope is folded and sealed. Tear-off strip 229 can be removed by the recipient, along with strip 220 when opening the mailer envelope. In this variation of the embodiment having an L-shaped and removable strip, the perpendicular perforations 217 and 235 include a perforation or die cut forming a substantially U-shaped thumb notch 221 and 237 such that removal of the strips 220 and 236 provide access to the contents of the mailer by the recipient.

Document section 212 further comprises perforation 223 formed parallel and approximately ¼ to ¾, preferably ⅜, inches interior to perforation 214, and continues across the entire width of document section 212, forming tear-off strip 232. This face of tear-off strip 232, in the folded configuration of the mailer, is mated with and adhered to tear-off strip 236 described below.

Document section 212 further comprises perforations 233 and 234 which are formed parallel and approximately ¼ to ¾, preferably ⅜, inches interior to each respective side edge of document section 212. Perforation 233 forms tear-off strip 233A which, in folded configuration, mates to side tear-off strip 236 of front ply section 211 and side tear-off strip 220 of back ply section 213. Perforation 234, which preferably can be a line of weakening formed by a die-cut having "ties" formed therein, provides side strip 234A, which remains as part of the mailer when document section 212 is removed by the recipient.

Mailer envelope front ply section 211 comprises perforation 235, which forms an L-shaped tear-away or tear-off strip 236 along two edges of front ply section 211. Therefore, perforation 235 is formed parallel to and approximately ¼–¾ of an inch from perforation 214, and continues vertically along one perpendicular edge of the form. Perforation 235 thereby allows for removal of strip 236 by the recipient in opening the folded and sealed mailer envelope. This perforation provides sealer flap 240 which allows printing of postage indicia flush with this perforation, and thus the edge of the form, avoiding a ¼ to ⅜ inch non-printable border left by most non-impact printers. It is preferred by the USPS that postage indicia is within ⅛ inch or less from the top edge of the mailer envelope.

Mailer envelope front ply 211 further comprises perforation 238 parallel and approximately ½ to ¾ inches interior to top edge 239, forming therebetween a sealer flap 240 for the mailer envelope. Perforation 238 can provide a fold line which mates with fold line 216 such that sealer flap 240 folds over extension strip 219 when the form 200 is in its folded and sealed configuration.

In addition, this mailer envelope front ply section 211 includes die-cut window areas 241, 242, and optionally, 243 which allow viewing of printed information therethrough when the mailer envelope is folded and sealed. Front ply section 211 can optionally be layered with a substantially transparent ply for protection of the mailer document contents, as previously described herein for other embodiments, and illustrated, for example, by the embodiment shown in FIG. 3.

Window 241 provides for viewing and scanning addressee (recipient) address information; window 242 provides for viewing return address (user address) information; and window area 243 provides for viewing of postal indicia. Window 241 is shown in its preferred configuration as a "stepped" window, i.e., wider in at least one dimension, to accommodate bar-coded information in accordance with certain USPS regulations. Similarly, window 243 is also shown in a preferred "stepped" configuration. The postage indicia window 243, however, is shown in a most preferred configuration having a stepped area in two dimensions. The stepped area which meets perforation 238 provides for a facing identification mark (FIM) to be positioned flush with the top edge of the mailer envelope (perforation 238, when folded and sealed). In addition, a second stepped area can be provided in a perpendicular direction to allow for a 2-dimensional bar code to be printed. These configurations can be particularly advantageous for use with PC Postage.

Figure 13:
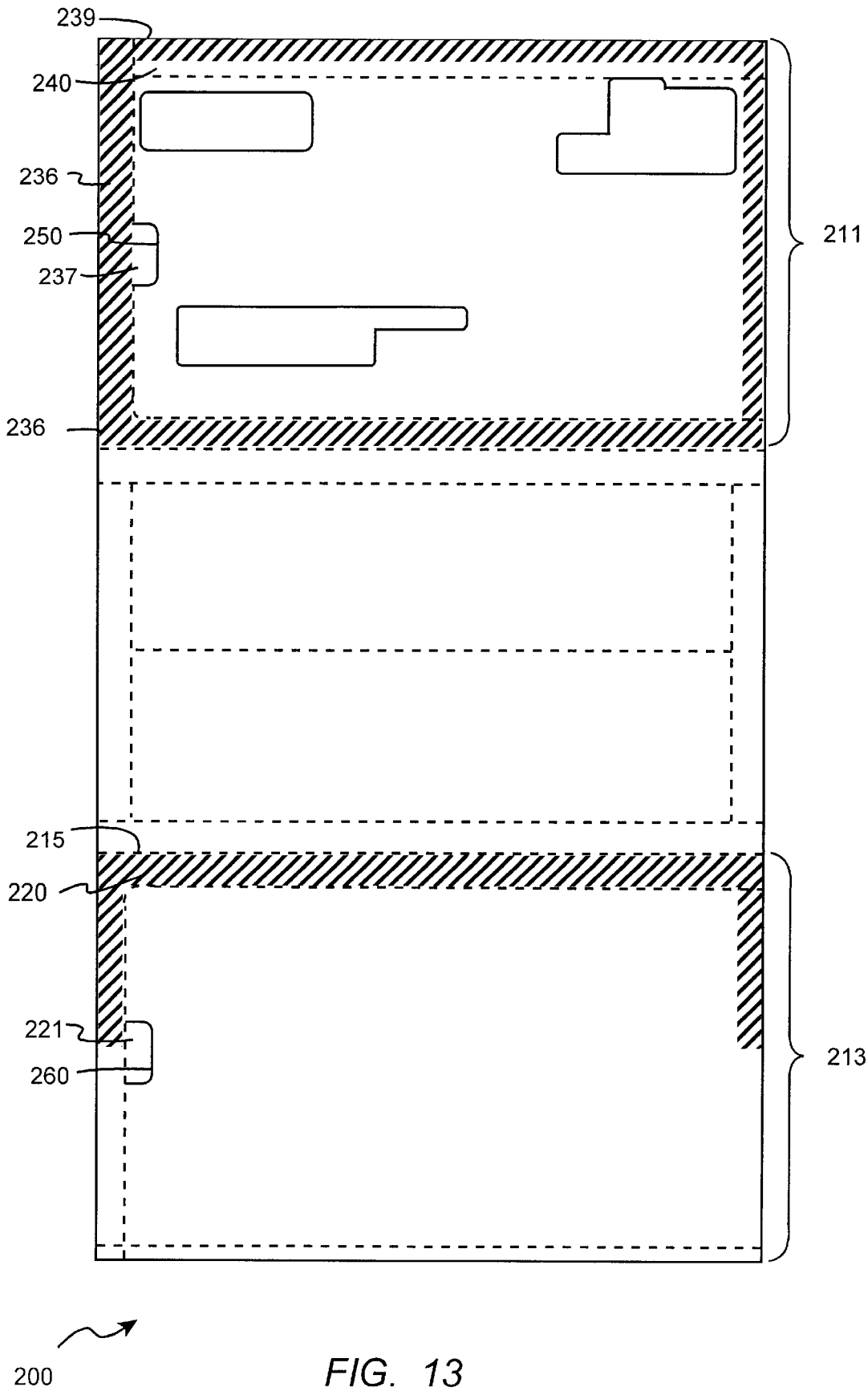
FIG. 13 is a plan view of a front face of the mailer as shown in FIG. 12, illustrating areas of disposed adhesive.

FIG. 13 is the same view of the front face of form 200 as shown in FIG. 12, but illustrates the position of adhesive disposed thereon in order to provide an adhesive seal around the entire perimeter edge of the mailer. Adhesive (shown as hatching), which is preferably a pressure-seal or pressure-activated adhesive, can be disposed on tear-off strip 236 of front ply section 211 such that a portion of notched area 237 remains adhesive-free, allowing underlying areas of document section 112 to not adhere and thereby be exposed when L-shaped tear-off strip 236 is removed. Adhesive is also preferably disposed along both edges opposite each leg of the L-shaped tear-off strip 236. Preferably, the adhesive disposed along top edge 239 is disposed only about half the width of strip 240. This adhesive can be pressure-seal, pressure-activated, or re-moistenable adhesive, as is well known in the art.

In addition, to form a completely sealed mailer, pressure-seal or pressure-activated adhesive can be disposed on edges of back ply section 213. Preferably, the adhesive is disposed substantially on all of the portion of tear-off strip 220 parallel to perforation 215, and then extends about half way along the vertical side edges perpendicular thereto. Again, an adhesive free area is left remaining on notch area 221 to provide non-adherence to document section 212.

Co-adhesive material, which mates to and thereby forms a seal with the adhesive material (shown as stippling), can be disposed onto the face of the form in a position opposing the adhesive. Accordingly, in this embodiment variation, co-adhesive is shown disposed on around the entire perimeter edges of section 212 and on the remaining perimeter edge of section 213 where adhesive is not disposed.

It would be readily understood by persons of ordinary skill in the art that any disposed adhesive can be disposed as shown, or on any mated section of the mailer in order to completely seal the mailer. In other words, wherever adhesive is shown as being disposed, a co-adhesive can be disposed thereon in place of the adhesive, so long as all mated sections have an adhesive/co-adhesive material which mate to one another.

Figure 14:
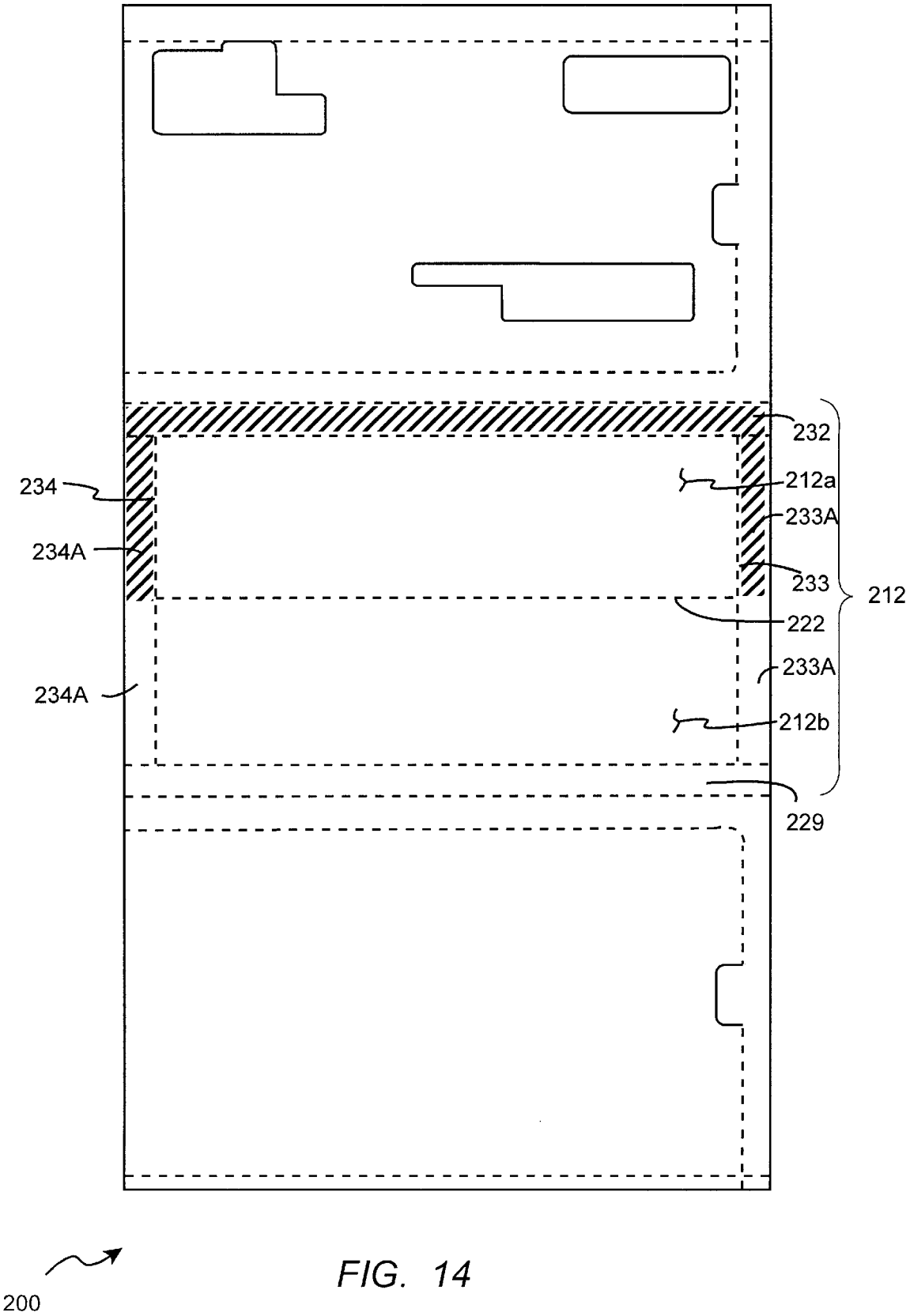
FIG. 14 is a plan view of a back face of the mailer as shown in FIG. 12, illustrating areas of disposed adhesive.

FIG. 14 is a plan view of a back face of mailer 200, showing areas where adhesive can be disposed in order to completely seal the outgoing mailer after or during folding. Preferably, a pressure-seal or pressure-activated adhesive can be disposed along certain edge strips of document section 212, and most preferably along tear-off strip 232 and its contiguous side strips 233A and 234A of document section 212*a*. This disposed adhesive can then mate with corresponding areas on document section 212*b*, which have co-adhesive material disposed thereon, when in its folded configuration. Thus, in this variation of the present embodiment, co-adhesive is disposed on areas 234A, 233A, and 229 of section 212*b*. In addition, a strip of co-adhesive can be disposed on section 213, along perforation 216 in order to mate with the adhesive disposed onto the inner face of tear-off strip 214 when this strip is folded over to seal the outgoing envelope. Again, as would be understood in the art, adhesive can alternatively be disposed on the mated areas or in a mated pattern such that the mailer is completely sealed around its perimeter in its folded configuration (e.g., adhesive disposed on the remainder of side strips 233A and 234A, and tear-off strip 229).

This embodiment of the subject form, once manufactured in its flat configuration as illustrated in FIGS. 9–14, can be pre-printed with instructions for use on any preferred face, e.g., on the back face of the back mailer envelope sections 113 or 213. For security purposes, the inner faces of the mailer envelope sections can also be pre-printed with a pantograph to prevent viewing of the contents within the envelope. A safety pantograph can also be printed on the document section to prevent alteration or other manipulation of the document. A printed pantograph is illustrated in FIG. 6 and would be readily adaptable to the embodiments described and shown in FIGS. 9–14.

Figure 14A:
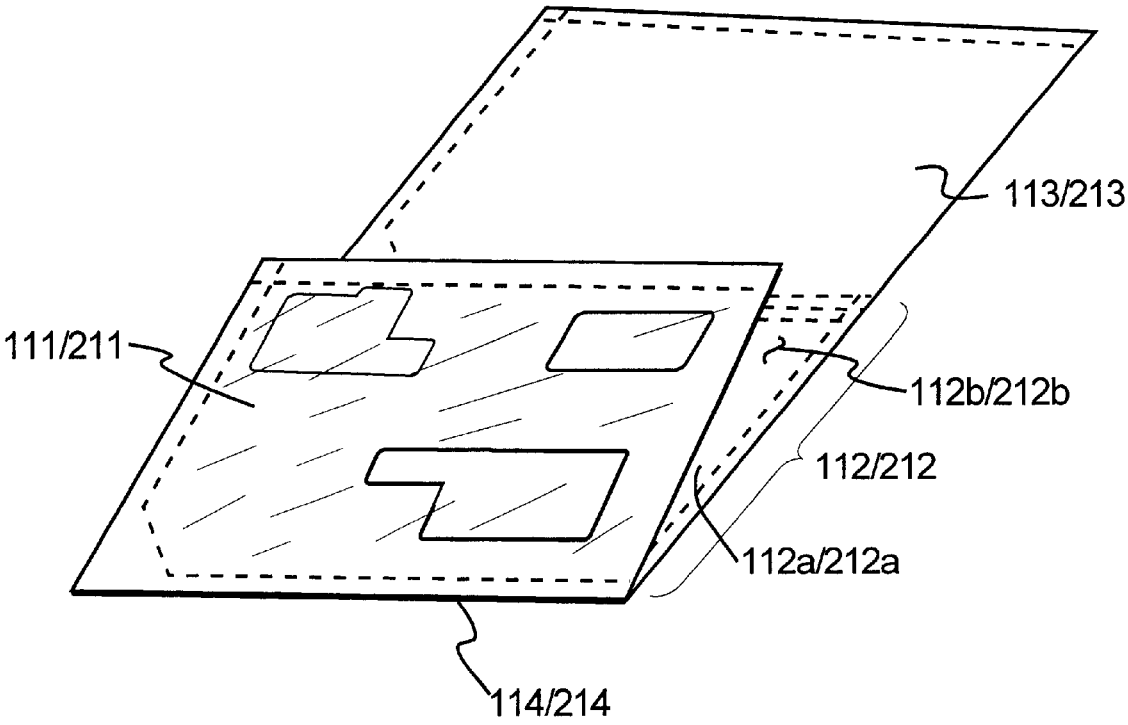
FIG. 14A shows a perspective view of an embodiment of the subject invention in its initial folded configuration for printing.

Referring to FIG. 14A, the variation shown is the form of FIGS. 9–11 (corner notch configuration), but is also illustrative of the variation of FIGS. 12–14 (thumb-notch variation). Therefore, the reference numbers are provided as being applicable to both variations. For use, the manufactured form is preferably plow-folded along perforation 114/214 whereby the back face of mailer envelope front ply section 111/211 is plow-folded to meet and contact the back face of document section 112/212. The form is preferably provided to the user in this configuration, wherein a substantially transparent backing sheet 152/252 provided for covering the window areas of section 111/211, and overlying perforation 114/214, provides a leading edge of the form for feeding through a simplex, non-impact printer. This plow-fold results in a form approximately 14 inches in length, allowing section 111/211 to freely hang in relation to the rest of the form. The inventor refers to this configuration as a "hanging tail" configuration. For use in certain printers, e.g., a laser printer, it is preferred to include a matte varnish coating along at least one face of the leading edge of the transparent sheet 152/252 to provide adequate surface friction and facilitate feeding of the form through the feeder mechanism of the printer.

The form in this hanging tail configuration can then be printed by the user wherein the voucher information and recipient address information is printed on the printing (front) face of document section 112*a*/212*a*, the check or other information is printed in the appropriate area of the printing (front) face of document section 112*b*/212*b*, and return address information and PC Postage indicia are printed in the appropriate areas of the printing (front) face of mailer envelope back ply section 113/213. Appropriate positioning of the information on each of these sections can be achieved using available software, or by adapting available software for such purposes.

Figure 15:
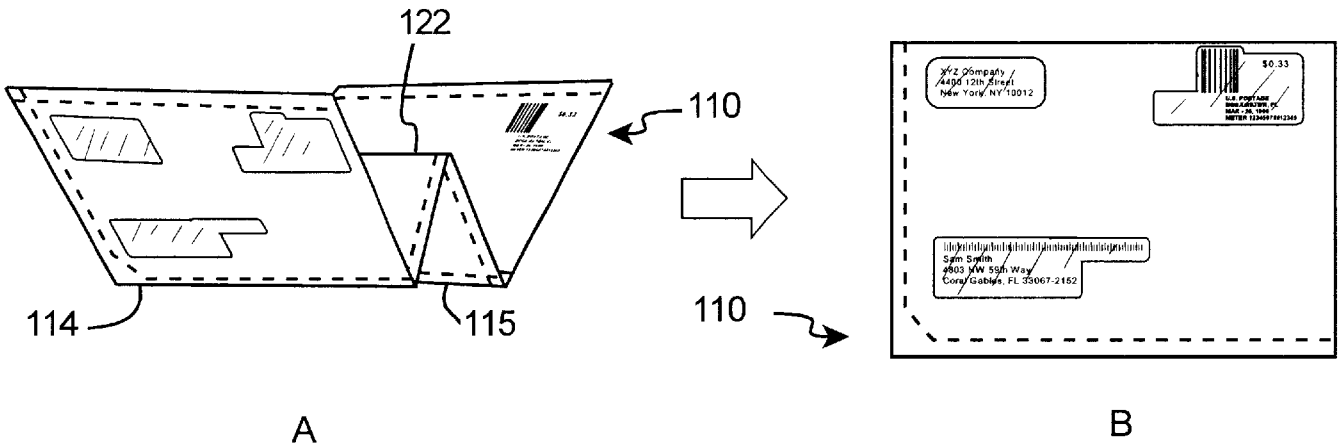
FIG. 15 shows a corner-notch variation of the embodiment of FIG. 9, being folded in its "W"-folded configuration, then as sealed.

FIG. 15 shows a corner-notch variation of the embodiment of FIG. 9, being folded in its "W"-folded configuration (A), then as sealed (B). Mailer form 110 is folded along fold lines 114, 122, and 115.

Figure 16:
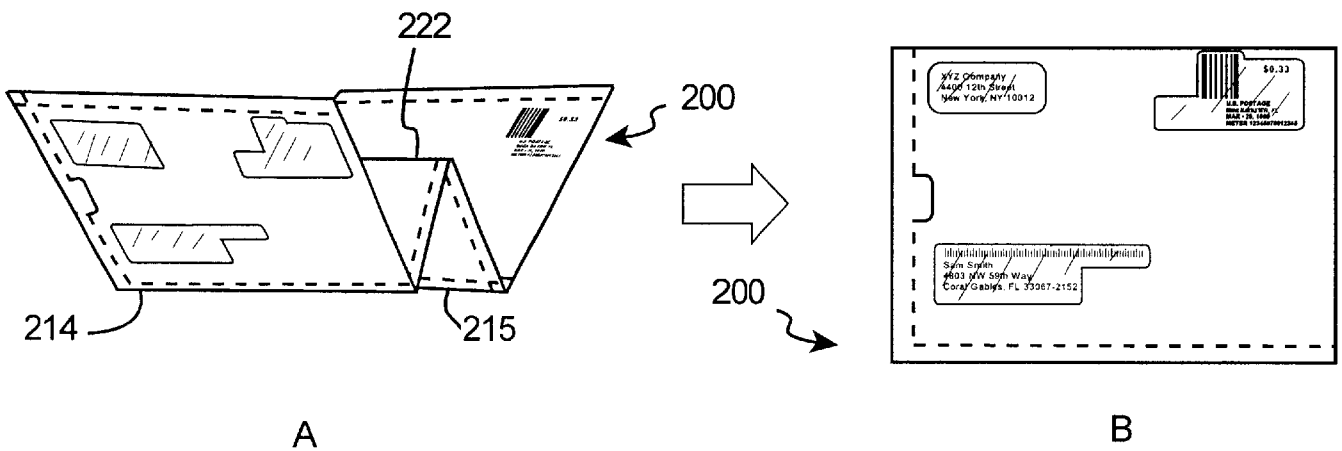
FIG. 16 shows a thumb-notch variation of the embodiment of FIG. 12, being folded in its "W"-folded configuration, then as sealed.

FIG. 16 shows a thumb-notch variation of the embodiment of FIG. 12, being folded in its "W"-folded configuration (A), then as sealed (B). Mailer form 200 is folded along fold lines 214, 222, and 215.

Figure 17:
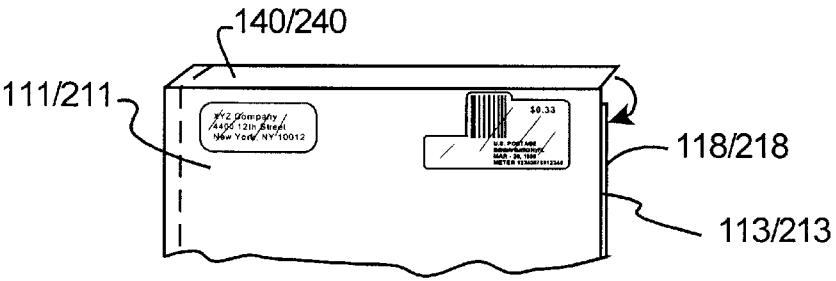
FIG. 17 is a partial view of the mailer according to the subject invention, illustrating the top edge in a "folded-over" configuration.

FIG. 17 is a partial view of the mailer according to the subject invention, illustrating the top edge in a "folded-over" configuration, wherein section 140/240 of front ply section 111/211 extends beyond bottom edge 118/218 of sections 113/213 in folded configuration, and is then folded over this bottom edge to contact and seal with front face of back ply section 113/213.

Figure 18:
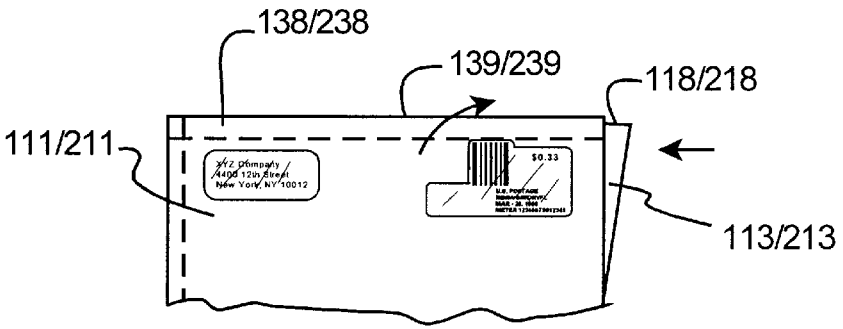
FIG. 18 is a partial view of the mailer according to the subject invention, illustrating the top edge in a "mated" configuration.

FIG. 18 is a partial view of the mailer according to the subject invention, illustrating the top edge in a "mated" configuration, wherein top edge 139/239 of front ply section 111/211 is mated to top edge 118/218 of back ply section 113/213.

Figure 19:
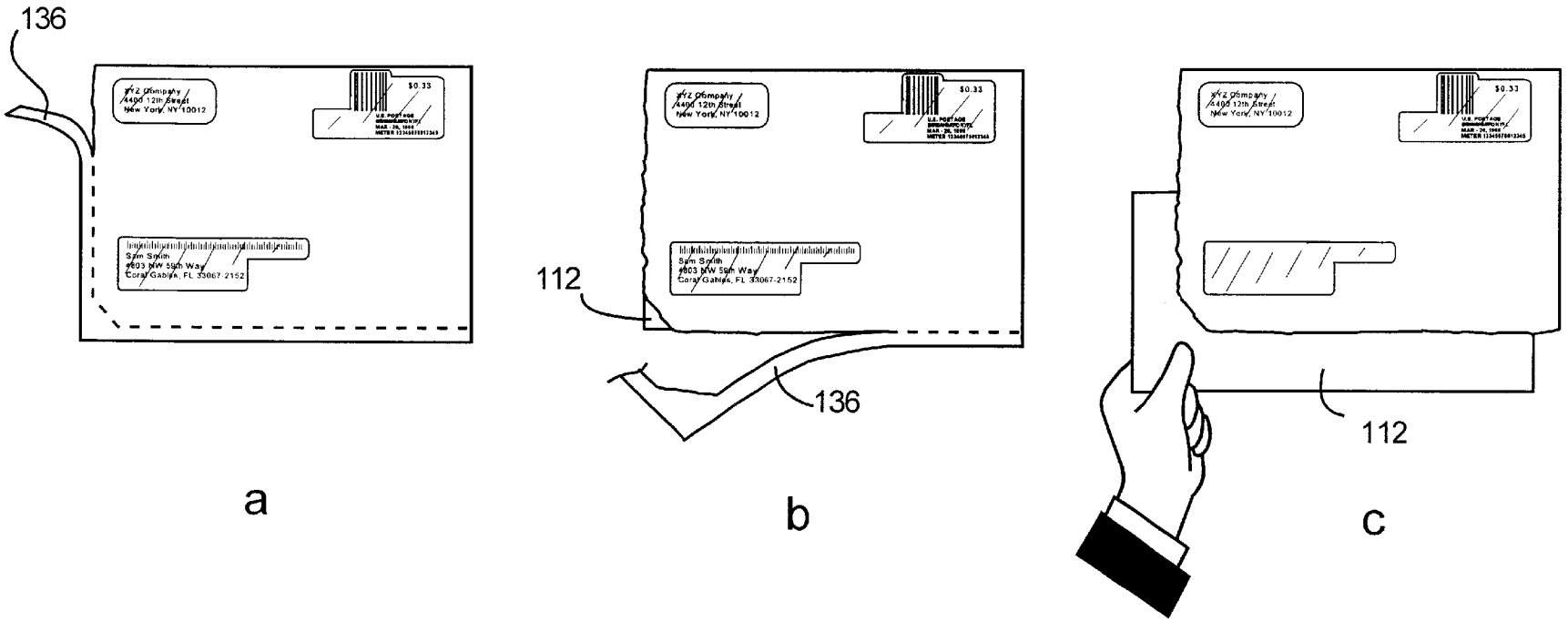
FIG. 19 is a step-wise illustration of the mailer variation of FIG. 9 as it is opened by a recipient.

FIG. 19 is a step-wise illustration of the mailer variation of FIG. 9 as it is opened by a recipient. L-shaped tear-off strip 136 is first removed from one side (step a). Then, the L-shaped tear-off strip 136 is removed along the bottom edge, exposing a corner of document section 112 at corner notch 137 (step b). Document section 112 is then pulled, defeating perforation 134 (not shown) to separate it from the mailer (step c).

Figure 20:
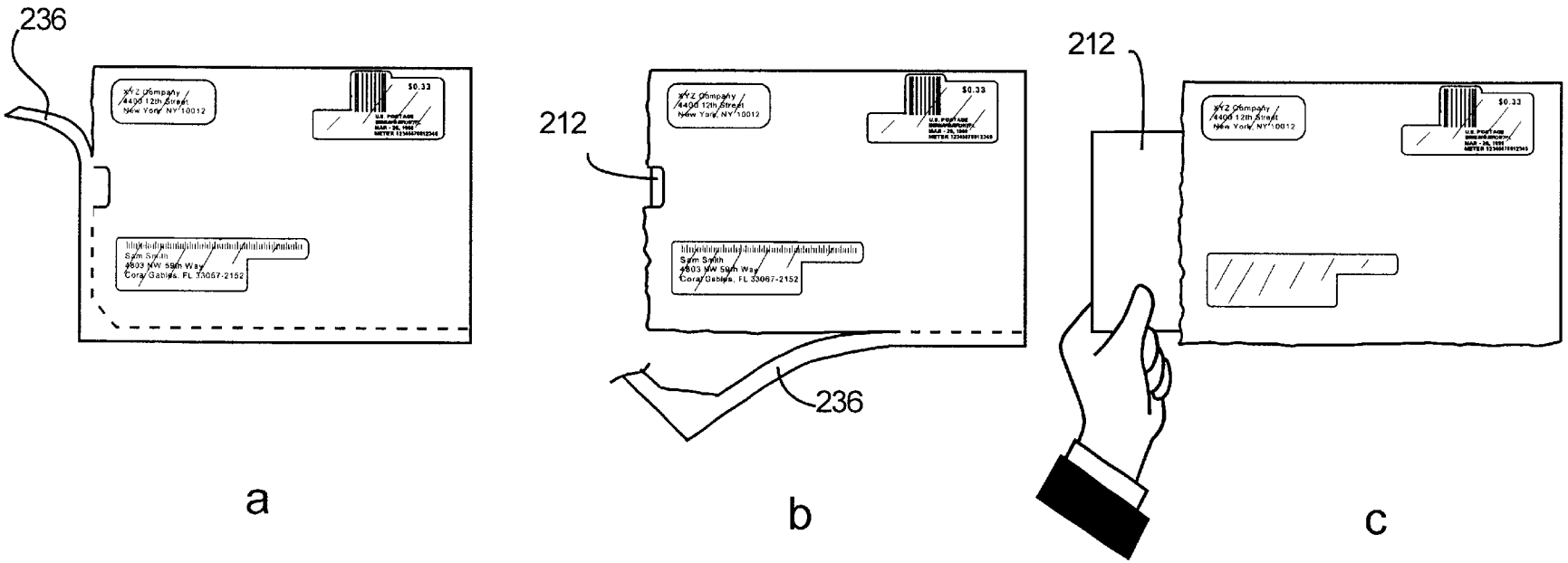
FIG. 20 is a step-wise illustration of the mailer variation of FIG. 12 as it is opened by a recipient.

FIG. 20 is a step-wise illustration of the mailer variation of FIG. 12 as it is opened by a recipient. L-shaped tear-off strip 236 is first removed from one side (step a). Then, the L-shaped tear-off strip 236 is removed along the bottom edge, exposing a section of document section 212 at thumb notch 237 (step b). Document section 212 is then pulled, defeating perforation 234 (not shown) to separate it from the mailer (step c).

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A mailing form comprising a single ply of substrate material having adhesive patternly disposed thereon for sealing, wherein said substrate material comprises at least three horizontal perforations which divide said substrate into four distinct panels, said panels comprising a first and second end panel and a first and second intermediate panel, said substrate being foldable and sealable to form an outgoing mailer from the first and second end panels and a financial document from the first and second intermediate panels, wherein said financial document is contained within said folded and sealed outgoing mailer.

2. The mailing form of claim 1, wherein said first end panel forms a front ply section of the outgoing mailer and said second end panel forms a back ply section of the outgoing mailer when the form is in its folded configuration.

3. The mailing form claim 2, wherein said financial document section foldably divides into a payment portion and a voucher portion.

4. The mailer form of claim 1, wherein the form comprises further perforations which provide tear-off strips for opening of a sealed mailer by a recipient of the mailer.

5. The mailing form of claim 3, wherein the payment portion is a check.

6. The mailing form of claim 1, wherein the substrate material is paper check stock in accordance with banking requirements.

7. The mailing form of claim 2, wherein the outgoing mailer front ply section includes window areas for viewing printed information therethrough.

8. The mailing form of claim 1, wherein the form further comprises a ply of transparent material for protecting the contents of the mailer when in folded and sealed.

9. The mailer form of claim 8, wherein the transparent material is heat and static resistant.

10. The mailer form of claim 8, wherein the transparent material ply comprises a die-cut forming a removable protective ring having adhesive-release material patternly disposed thereon, wherein said adhesive-release material allows removal of the protective ring which exposes adhesive disposed on the substrate ply.

11. The mailer form of claim 10, wherein the protective ring is permanently affixed to certain portions of the underlying substrate material whereby those affixed portions of the underlying substrate material are automatically removed upon removal of the protective ring.

12. The mailer form of claim 11, wherein the removed portions of the underlying substrate material are side strips and void areas formed in the financial document section.

13. The mailer form of claim 4, wherein said further perforations are configured to provide a notched area, forming a tab which is automatically removed with the tear-off strips, exposing the contents of the mailer such that said contents are accessible and removable from the mailer by a recipient.

14. The mailing form of claim 1, wherein all variable information printed on the form is printable by a single pass through a simplex, non-impact printer.

15. The mailing form of claim 1, wherein the form is printed with a security pantograph.

16. The mailing form of claim 15, wherein the security pantograph is printed on at least one interior face of the mailer to prevent-viewing of contents within the mailer.

17. The mailing form of claim 15, wherein the security pantograph is printed on the financial document to prevent alteration of the financial document.

18. The mailing form of claim 1, wherein the form is plow-folded to provide a pre-folded form for a user.

* * * * *